US010415377B2

(12) United States Patent
Lee et al.

(10) Patent No.: US 10,415,377 B2
(45) Date of Patent: Sep. 17, 2019

(54) FLUID PRESSURE PULSE GENERATOR AND FLOW BYPASS SLEEVE FOR A TELEMETRY TOOL

(71) Applicant: Evolution Engineering Inc., Calgary (CA)

(72) Inventors: Gavin Gaw-Wae Lee, Calgary (CA); Luke Stack, Calgary (CA); Aaron W. Logan, Calgary (CA)

(73) Assignee: Evolution Engineering Inc., Calgary (CA)

( * ) Notice: Subject to any disclaimer, the term of this patent is extended or adjusted under 35 U.S.C. 154(b) by 0 days.

(21) Appl. No.: 16/034,041

(22) Filed: Jul. 12, 2018

(65) Prior Publication Data

US 2019/0017372 A1 Jan. 17, 2019

Related U.S. Application Data

(60) Provisional application No. 62/532,721, filed on Jul. 14, 2017.

(51) Int. Cl.
*E21B 34/08* (2006.01)
*E21B 47/12* (2012.01)
(Continued)

(52) U.S. Cl.
CPC ..... *E21B 47/185* (2013.01); *E21B 34/08* (2013.01); *E21B 47/187* (2013.01); *E21B 47/12* (2013.01); *E21B 47/14* (2013.01); *E21B 47/18* (2013.01)

(58) Field of Classification Search
CPC ..... E21B 47/12; E21B 47/14; E21B 47/18; E21B 47/182; E21B 47/185; E21B 47/187; E21B 34/08
See application file for complete search history.

(56) References Cited

U.S. PATENT DOCUMENTS 3,739,331 A 6/1973 Godbey et al.
4,914,637 A 4/1990 Goodsman
(Continued)

FOREIGN PATENT DOCUMENTS

CA 1228909 11/1987
CA 1268052 4/1990
(Continued)

OTHER PUBLICATIONS

International Search Report and Written Opinion dated Sep. 18, 2015, in PCT/CA2015/050587, filed Jun. 25, 2015.
(Continued)

*Primary Examiner* — Franklin D Balseca
(74) *Attorney, Agent, or Firm* — Hovey Williams LLP

(57) ABSTRACT

A fluid pressure pulse generator for a telemetry tool comprising a stator and a rotor. The stator comprising a stator body and a plurality of radially extending stator projections spaced around the stator body, whereby adjacently spaced stator projections define stator flow channels extending therebetween. The rotor comprising a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to generate fluid pressure pulses in fluid flowing through the stator flow channels. At least one of the rotor projections has an angled rotor bypass channel which moves in and out of fluid communication with the stator flow channels as the rotor rotates relative to the stator, the angled rotor bypass channel extending through or along a surface of the at least one rotor projection and having a fluid inlet and a fluid outlet downhole and lateral relative to the fluid inlet. The angled rotor bypass channel providing a self-correction mechanism
(Continued)

causing the rotor to rotate to an open flow position when there is failure of the telemetry tool.

11 Claims, 20 Drawing Sheets

(51) Int. Cl.
*E21B 47/14* (2006.01)
*E21B 47/18* (2012.01)

(56) References Cited

U.S. PATENT DOCUMENTS

| | | | |
|---|---|---|---|
| 5,357,483 | A | 10/1994 | Innes |
| 5,586,083 | A | 12/1996 | Chin et al. |
| 5,636,178 | A | 6/1997 | Ritter |
| 5,740,126 | A | 4/1998 | Chin et al. |
| 7,083,008 | B2 | 8/2006 | Thorp et al. |
| 7,133,325 | B2 | 11/2006 | Kotsonis et al. |
| 7,230,880 | B2 | 6/2007 | Lehr |
| 8,020,632 | B2 | 9/2011 | Moriarty |
| 8,138,943 | B2 | 3/2012 | Kusko et al. |
| 8,151,905 | B2 | 4/2012 | Song |
| 8,181,719 | B2 | 5/2012 | Bunney et al. |
| 9,840,909 | B2 | 12/2017 | Lee et al. |
| 2009/0266544 | A1 | 10/2009 | Redlinger et al. |
| 2011/0280105 | A1 | 11/2011 | Hall et al. |
| 2014/0028293 | A1 | 1/2014 | Johnson et al. |

FOREIGN PATENT DOCUMENTS

| | | | | |
|---|---|---|---|---|
| CA | 1299998 | | 5/1992 | |
| CA | 2174017 | | 10/1996 | |
| CA | 2098676 | | 11/1997 | |
| CA | 2528999 | | 9/2009 | |
| CA | 2506912 | | 7/2013 | |
| CA | 2855930 | | 5/2014 | |
| CN | 203271731 | | 11/2013 | |
| CN | 203452776 | | 2/2014 | |
| CN | 103410503 | | 6/2016 | |
| GB | 2271790 | | 2/1996 | |
| GB | 2443096 | | 10/2008 | |
| WO | 2014/071514 | | 5/2014 | |
| WO | WO-2015196282 | A1 * | 12/2015 | ..... E21B 47/182 |
| WO | WO-2015196288 | A1 * | 12/2015 | ..... E21B 47/187 |

OTHER PUBLICATIONS

International Search Report and Written Opinion dated Sep. 23, 2015, in PCT/CA2015/050586, filed Jun. 25, 2015.
International Search Report and Written Opinion dated Sep. 22, 2015, in PCT/CA2015/050576, filed Jun. 22, 2015.
International Search Report and Written Opinion dated Jan. 17, 2017, in PCT/CA2016/051298, filed Nov. 8, 2016.

* cited by examiner

FLUID PRESSURE PULSE GENERATOR AND FLOW BYPASS SLEEVE FOR A TELEMETRY TOOL

CROSS-REFERENCE TO RELATED APPLICATIONS

The present application claims the benefit of Provisional Patent Application No. 62/532,721, filed Jul. 14, 2017, which is hereby incorporated by reference in its entirety.

FIELD

This disclosure relates generally to a fluid pressure pulse generator and flow bypass sleeve for a telemetry tool, such as a mud pulse telemetry measurement-while-drilling ("MWD") tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight drill collars. The BHA is conveyed into the wellbore by a string of metallic tubulars (i.e. drill pipe). MWD equipment is used to provide downhole sensor and status information to surface while drilling in a near real-time mode. This information is used by a rig crew to make decisions about controlling and steering the well to optimize the drilling speed and trajectory based on numerous factors, including lease boundaries, existing wells, formation properties, and hydrocarbon size and location. The rig crew can make intentional deviations from the planned wellbore path as necessary based on the information gathered from the downhole sensors during the drilling process. The ability to obtain real-time MWD data allows for a relatively more economical and more efficient drilling operation.

One type of downhole MWD telemetry known as mud pulse telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor can be rotated relative to the stator between an opened position where there is no restriction of mud flowing through the valve and no pulse is generated, and a restricted flow position where there is restriction of mud flowing through the valve and a pressure pulse is generated.

SUMMARY

According to a first aspect, there is provided a fluid pressure pulse generator for a telemetry tool comprising a stator and a rotor. The stator comprises a stator body and a plurality of radially extending stator projections spaced around the stator body, whereby adjacently spaced stator projections define stator flow channels extending therebetween. The rotor comprises a rotor body and a plurality of radially extending rotor projections spaced around the rotor body. The rotor projections are axially adjacent the stator projections and the rotor is rotatable relative to the stator such that the rotor projections move in and out of fluid communication with the stator flow channels to generate fluid pressure pulses in fluid flowing through the stator flow channels. At least one of the rotor projections has an angled rotor bypass channel which moves in and out of fluid communication with the stator flow channels as the rotor rotates relative to the stator, the angled rotor bypass channel extending through or along a surface of the at least one rotor projection and having a fluid inlet and a fluid outlet downhole and lateral relative to the fluid inlet.

The angled rotor bypass channel may be configured such that fluid flowing along the angled rotor bypass channel and discharging from the fluid outlet when the angled rotor bypass channel is in fluid communication with the stator flow channels has a vector with at least a lateral component and a longitudinal component.

The rotor projections may have a radial profile with an uphole end and a downhole end, with two opposed side faces extending between the uphole end and the downhole end. The angled rotor bypass channel may comprise an aperture extending through the at least one rotor projection with the fluid inlet at the uphole end and the fluid outlet at the downhole end.

The rotor projections may have a radial profile with an uphole face and a downhole end, with two opposed side faces and a distal end face extending between the uphole face and the downhole end. The angled rotor bypass channel may comprise an aperture extending through the at least one rotor projection with the fluid inlet on the uphole face and the fluid outlet on one of the side faces or on the distal end face.

The rotor projections may have a radial profile with an uphole end and a downhole face, with two opposed side faces and a distal end face extending between the uphole end and the downhole face. The angled rotor bypass channel may comprise an aperture extending through the at least one rotor projection with the fluid inlet on one of the side faces or on the distal end face, and the fluid outlet on the downhole face.

The aperture may taper towards the fluid inlet.

The rotor projections may have a radial profile with an uphole end and a downhole end, with two opposed side faces and a distal end face extending between the uphole end and the downhole end. The angled rotor bypass channel may comprise a groove extending along the distal end face.

The stator body may have a bore therethrough and at least a portion of the rotor body may be received within the bore. The rotor body may have a bore therethrough and the fluid pressure pulse generator may further comprise a rotor cap comprising a cap body and a cap shaft. The cap shaft may be received in the bore of the rotor body and configured to releasably couple the rotor body to a driveshaft of the telemetry tool.

According to another aspect, there is provided a telemetry tool comprising: a pulser assembly comprising a housing enclosing a motor coupled with a driveshaft; and the fluid pressure pulse generator of the first aspect. The driveshaft is coupled to the rotor and the motor rotates the driveshaft and rotor relative to the stator such that the rotor projections move in and out of fluid communication with the stator flow channels to generate fluid pressure pulses in fluid flowing through the stator flow channels.

The stator body may have a bore therethrough and may be fixedly coupled with the housing, and the rotor may be fixedly coupled with the driveshaft with the driveshaft and/or the rotor body received within the bore of the stator body such that the stator projections are positioned between the pulser assembly and the rotor projections. The rotor body may have a bore therethrough and the telemetry tool may further comprise a rotor cap comprising a cap body and a cap shaft. The cap shaft may be received in the bore of the rotor body and configured to releasably couple the rotor body to the driveshaft.

According to another aspect, there is provided a flow bypass sleeve for a fluid pressure pulse generator of a downhole telemetry tool comprising a plurality of radially extending stator projections spaced around a stator body and a plurality of radially extending rotor projections spaced around a rotor body and axially adjacent the stator projections. The flow bypass sleeve being configured to fit inside a drill collar which houses the telemetry tool and comprising a sleeve body with a bore therethrough which receives the fluid pressure pulse generator. The sleeve body comprising at least one longitudinally extending angled sleeve bypass channel with a fluid inlet and a fluid outlet. The fluid outlet is on an internal surface of the sleeve body and is downhole and lateral relative to the fluid inlet. The at least one angled sleeve bypass channel is positioned such that the rotor projections rotate in and out of fluid communication with the at least one angled sleeve bypass channel when the fluid pressure pulse generator is received in the bore of the sleeve body and the rotor projections are rotating relative to the stator projections to generate fluid pressure pulses in fluid flowing through the fluid pressure pulse generator.

The at least one angled sleeve bypass channel may comprise an angled groove longitudinally extending along an internal surface of the sleeve body.

The sleeve body may further comprise at least one bypass aperture longitudinally extending through the sleeve body. The fluid may flow through the at least one bypass aperture and the angled groove.

The sleeve body may comprise a plurality of angled grooves longitudinally extending along an internal surface of the sleeve body and the plurality of angled grooves may be positioned such that the rotor projections rotate in and out of fluid communication with the plurality of angled grooves when the fluid pressure pulse generator is received in the bore of the sleeve body and the rotor projections are rotating relative to the stator projections to generate fluid pressure pulses in fluid flowing through the fluid pressure pulse generator.

According to a further aspect, there is provided a telemetry tool comprising a pulser assembly, a fluid pressure pulse generator and a flow bypass sleeve. The pulser assembly comprising a housing enclosing a motor coupled with a driveshaft. The fluid pressure pulse generator comprising: a stator comprising a stator body and a plurality of radially extending stator projections spaced around the stator body, whereby adjacently spaced stator projections define stator flow channels extending therebetween; and a rotor comprising a rotor body and a plurality of radially extending rotor projections spaced around the rotor body. The flow bypass sleeve configured to fit inside a drill collar which houses the telemetry tool and comprising a sleeve body with a bore therethrough which receives the fluid pressure pulse generator. The sleeve body comprising at least one longitudinally extending angled sleeve bypass channel with a fluid inlet and a fluid outlet. The fluid outlet is on an internal surface of the sleeve body and is downhole and lateral relative to the fluid inlet. The driveshaft is coupled to the rotor and the motor rotates the driveshaft and rotor relative to the stator such that the rotor projections move in and out of fluid communication with the stator flow channels to generate fluid pressure pulses in fluid flowing through the stator flow channels. The at least one angled sleeve bypass channel is positioned such that the rotor projections rotate in and out of fluid communication with the at least one angled sleeve bypass channel when the rotor is rotating relative to the stator to generate the fluid pressure pulses.

The at least one angled sleeve bypass channel may comprise an angled groove longitudinally extending along an internal surface of the sleeve body.

The sleeve body may further comprise at least one bypass aperture longitudinally extending through the sleeve body. The fluid may flow through the at least one bypass aperture and the angled groove.

The sleeve body may comprise a plurality of angled grooves longitudinally extending along an internal surface of the sleeve body and the plurality of angled grooves may be positioned such that the rotor projections rotate in and out of fluid communication with the plurality of angled grooves when the rotor projections are rotating relative to the stator projections to generate the fluid pressure pulses.

The fluid pressure pulse generator may comprise the fluid pressure pulse generator of the first aspect.

The stator body may have a bore therethrough and may be fixedly coupled with the housing. The rotor may be fixedly coupled with the driveshaft with the driveshaft and/or the rotor body received within the bore of the stator body such that the stator projections are positioned between the pulser assembly and the rotor projections. The rotor body may have a bore therethrough and the telemetry tool may further comprise a rotor cap comprising a cap body and a cap shaft.

The cap shaft may be received in the bore of the rotor body and configured to releasably couple the rotor body to the driveshaft.

This summary does not necessarily describe the entire scope of all aspects. Other aspects, features and advantages will be apparent to those of ordinary skill in the art upon review of the following description of specific embodiments.

DETAILED DESCRIPTION OF EMBODIMENTS

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a fluid pressure pulse generator of a telemetry tool that can generate pressure pulses. The fluid pressure pulse generator may be used for mud pulse ("MP") telemetry used in downhole drilling, wherein a drilling fluid (herein referred to as "mud") is used to transmit telemetry pulses to surface. The fluid pressure pulse generator may alternatively be used in other methods where it is necessary to generate a fluid pressure pulse. The fluid pressure pulse generator comprises a stator and a rotor. The stator may be fixed to a pulser assembly of the telemetry tool or to a drill collar housing the telemetry tool, and the rotor is fixed to a driveshaft rotationally coupled to a motor in the pulser assembly. The motor rotates the driveshaft and rotor relative to the fixed stator.

Figure 1:
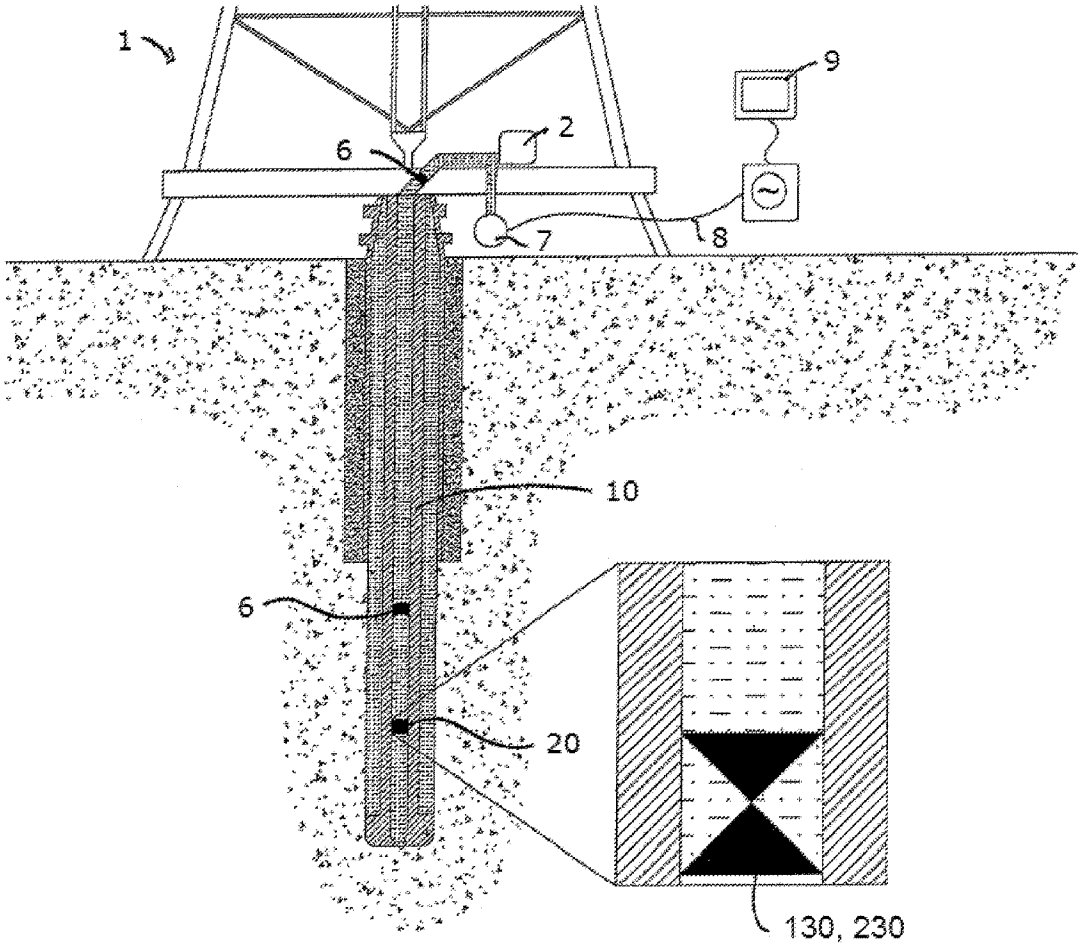
FIG. 1 is a schematic of a drill string in an oil and gas borehole comprising a MWD telemetry tool.

Referring to the drawings and specifically to FIG. 1, there is shown a schematic representation of MP telemetry operation using a fluid pressure pulse generator 130, 230 according to embodiments disclosed herein. In downhole drilling equipment 1, drilling mud is pumped down a drill string by pump 2 and passes through a measurement while drilling ("MWD") tool 20 including the fluid pressure pulse generator 130, 230. The fluid pressure pulse generator 130, 230 has an open flow position in which mud flows relatively unimpeded through the pressure pulse generator 130, 230 and no pressure pulse is generated and a restricted flow position where flow of mud through the pressure pulse generator 130, 230 is restricted and a positive pressure pulse is generated (represented schematically as block 6 in mud column 10). Information acquired by downhole sensors (not shown) is transmitted in specific time divisions by pressure pulses 6 in the mud column 10. More specifically, signals from sensor modules (not shown) in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which controls timing of the fluid pressure pulse generator 130, 230 to generate pressure pulses 6 in a controlled pattern which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency and these characteristics are used in various encoding systems to represent binary data.

Figure 2:
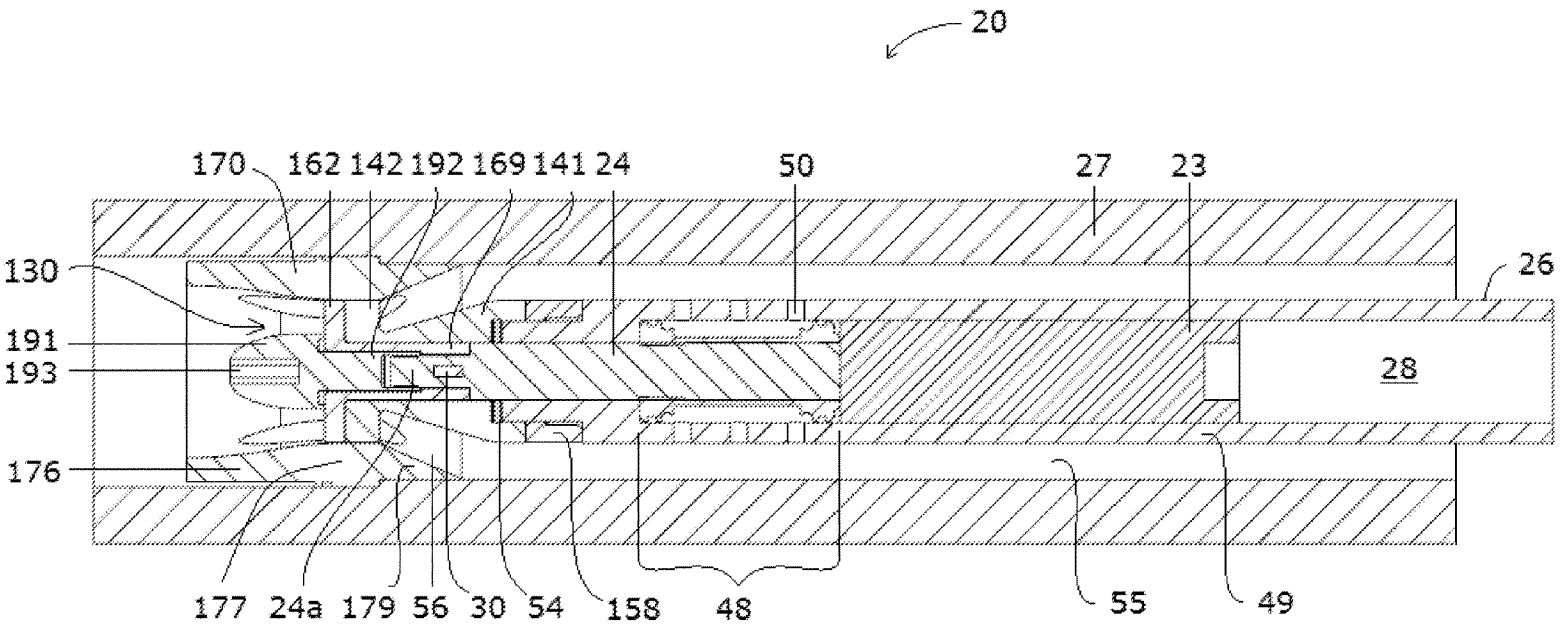
FIG. 2 is a longitudinally sectioned view of a mud pulser section of the MWD tool that includes a pulser assembly, a fluid pressure pulse generator in accordance with a first embodiment, and a first embodiment of a flow bypass sleeve that surrounds the fluid pressure pulse generator.
Figure 3:
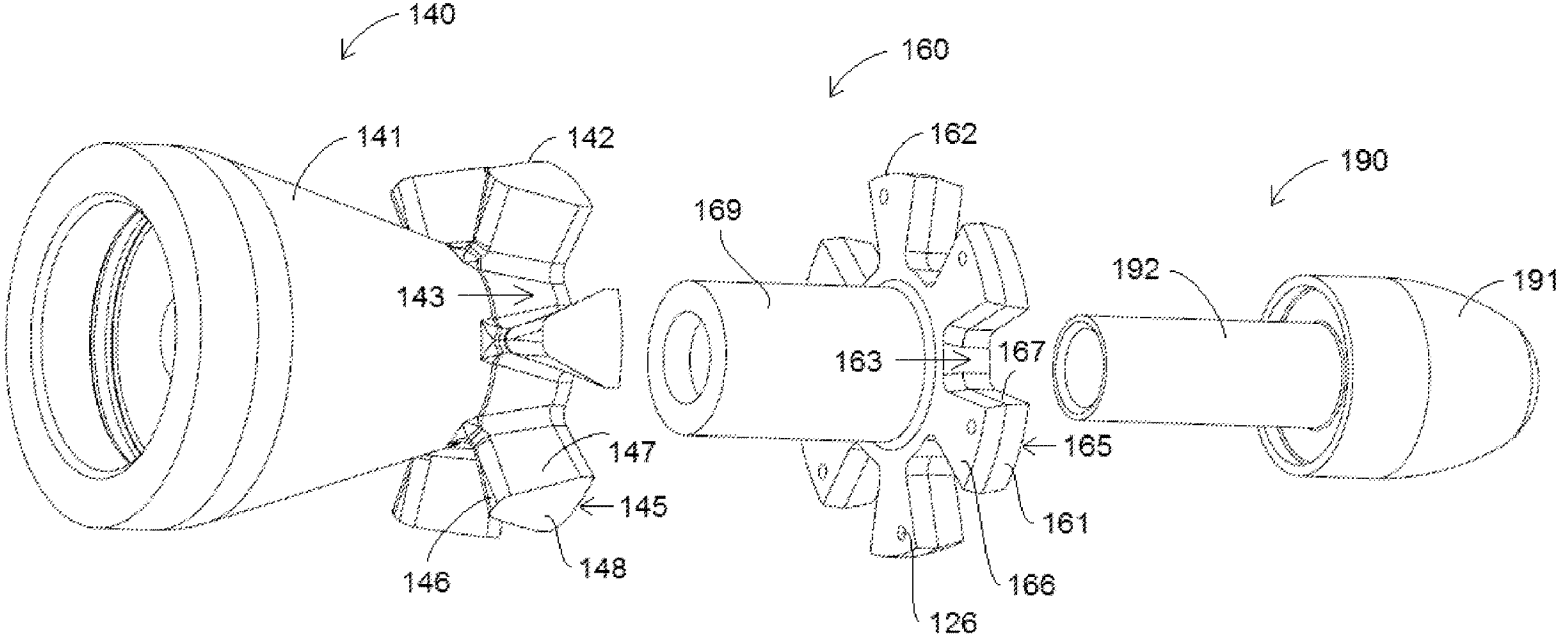
FIG. 3 is an exploded perspective view of the fluid pressure pulse generator of the first embodiment comprising a stator, a rotor and a rotor cap, the rotor comprising a rotor body and a plurality of rotor projections radially extending around the downhole end of the rotor body with angled apertures extending through the rotor projections.
Figure 4:
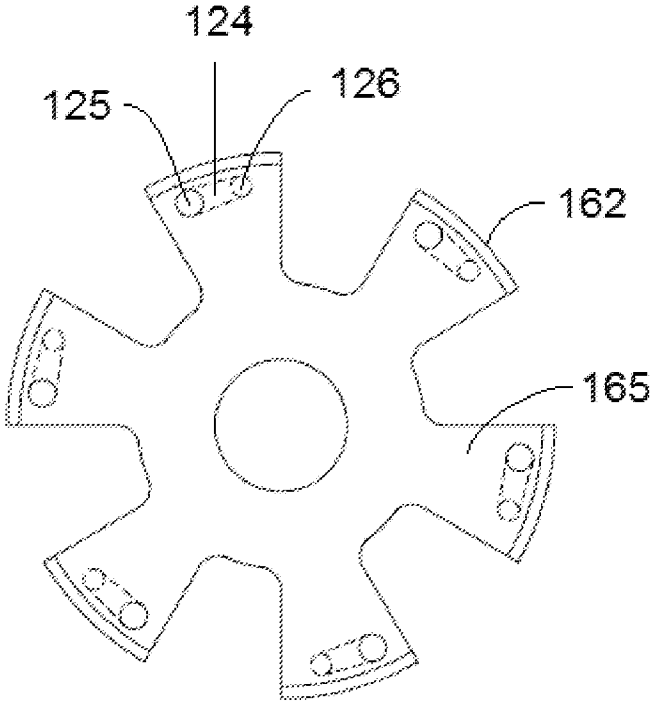
FIG. 4 is bottom view of the rotor of the fluid pressure pulse generator of the first embodiment with the angled apertures shown as dashed lines extending through the rotor projections.

Referring to FIG. 2, the downhole end of a MWD tool 20 is shown in more detail. The MWD tool 20 generally comprises a fluid pressure pulse generator 130 according to a first embodiment which creates fluid pressure pulses, and a pulser assembly 26 which takes measurements while drilling and which drives the fluid pressure pulse generator 130. The fluid pressure pulse generator 130 and pulser assembly 26 are axially located inside a drill collar 27. A flow bypass sleeve 170 according to a first embodiment is received inside the drill collar 27 and surrounds the fluid pressure pulse generator 130. The pulser assembly 26 is fixed to the drill collar 27 with an annular channel 55 therebetween, and mud flows along the annular channel 55 when the MWD tool 20 is downhole. The pulser assembly 26 comprises pulser assembly housing 49 enclosing a motor subassembly and an electronics subassembly 28 electronically coupled together but fluidly separated by a feed-through connector (not shown). The motor subassembly includes a motor and gearbox subassembly 23, a driveshaft 24 rotationally coupled to the motor and gearbox subassembly 23, and a pressure compensation device 48. The fluid pressure pulse generator 130 comprises a stator and a rotor. The stator comprises a stator body 141 with a bore therethrough and stator projections 142 radially extending around the downhole end of the stator body 141. The rotor comprises generally cylindrical rotor body 169 with a central bore therethrough and a plurality of radially extending projections 162 at the downhole end thereof.

The stator body 141 comprises a cylindrical section at the uphole end and a generally frusto-conical section at the downhole end which tapers longitudinally in the downhole direction. The cylindrical section of stator body 141 is fixedly coupled with the pulser assembly housing 49. More specifically, a jam ring 158 threaded on the stator body 141 is threaded onto the pulser assembly housing 49. Once the stator is positioned correctly, the stator is held in place and the jam ring 158 is backed off and torqued onto the stator body 141 holding it in place. The stator body 141 surrounds annular seal 54. A small amount of mud may be able to enter the fluid pressure pulse generator 130 between the rotor and the stator however this entry point is downhole from annular seal 54 so the mud has to travel uphole against gravity to reach annular seal 54. The velocity of mud impinging on annular seal 54 may therefore be reduced and there may be less wear of seal 54 compared to other rotor/stator designs. The external surface of the pulser assembly housing 49 is flush with the external surface of the cylindrical section of the stator body 141 for smooth flow of mud therealong. In alternative embodiments (not shown) other means of coupling the stator with the pulser assembly housing 49 may be utilized and the external surface of the stator body 141 and the pulser assembly housing 49 may not be flush.

The rotor body 169 is received in the downhole end of the bore through the stator body 141 and a downhole portion 24*a* of the driveshaft 24 is received in uphole end of the bore through the rotor body 169. A coupling key 30 extends through downhole driveshaft portion 24*a* and is received in a coupling key receptacle (not shown) to couple the driveshaft 24 with the rotor body 169. The coupling key 30 may be any type of coupling key and may be a coupling key 30 with a zero backlash ring as described in WO 2014/071519 (incorporated herein by reference). Alternative means of coupling the rotor body 169 to the driveshaft 24 may be used as would be known to a person skilled in the art.

A rotor cap comprising a cap body 191 and a cap shaft 192 is positioned at the downhole end of the fluid pressure pulse generator 130. The cap shaft 192 is received in the downhole end of the bore through the rotor body 169 and threads onto downhole driveshaft portion 24*a* to lock (torque) the rotor to the driveshaft 24. The cap body 191 includes a hexagonal shaped opening 193 dimensioned to receive a hexagonal Allen key which is used to torque the rotor to the driveshaft 24. The rotor cap therefore releasably couples the rotor to the driveshaft 24 so that the rotor can be easily removed and repaired or replaced if necessary using the Allen key. The rounded cone shaped cap body 191 may provide a streamlined flow path for mud and may reduce wear of the rotor projections 162 caused by recirculation of mud. The rounded cap body 191 may also reduce torque required to rotate the rotor by reducing turbulence downhole of the rotor. Positioning the rotor body 169 in the bore of the stator body 141 may protect the rotor body 169 from wear caused by mud erosion.

Rotation of the driveshaft 24 by the motor and gearbox subassembly 23 rotates the rotor relative to the fixed stator. The electronics subassembly 28 includes downhole sensors, control electronics, and other components required by the MWD tool 20 to determine direction and inclination information and to take measurements of drilling conditions, to encode this telemetry data using one or more known modulation techniques into a carrier wave, and to send motor control signals to the motor and gearbox subassembly 23 to rotate the driveshaft 24 and rotor in a controlled pattern to generate pressure pulses 6 representing the carrier wave for transmission to surface.

The motor subassembly is filled with a lubricating liquid such as hydraulic oil or silicon oil and this lubricating liquid is fluidly separated from mud flowing along annular channel 55 by annular seal 54 which surrounds the driveshaft 24. The pressure compensation device 48 comprises a flexible membrane (not shown) in fluid communication with the lubrication liquid on one side and with mud on the other side via ports 50 in the pulser assembly housing 49; this allows the pressure compensation device 48 to maintain the pressure of the lubrication liquid at about the same pressure as the mud in the annular channel 55. Without pressure compensation, the torque required to rotate the driveshaft 24 and rotor would need high current draw with excessive battery consumption resulting in increased costs. In alternative embodiments (not shown), the pressure compensation device 48 may be any pressure compensation device known in the art, such as pressure compensation devices that utilize pistons, metal membranes, or a bellows style pressure compensation mechanism.

In the embodiment shown in FIG. 2, the fluid pressure pulse generator 130 is located at the downhole end of the pulser assembly 26. Mud pumped from the surface by pump 2 flows along annular channel 55 between the outer surface of the pulser assembly 26 and the inner surface of the drill collar 27. When the mud reaches the fluid pressure pulse generator 130 it flows along an annular channel 56 provided between the external surface of the stator body 141 and the internal surface of the flow bypass sleeve 170. The rotor rotates between an open flow position where mud flows freely through the fluid pressure pulse generator 130 resulting in no pressure pulse and a restricted flow position where flow of mud is restricted to generate pressure pulse 6. In alternative embodiments, the fluid pressure pulse generator 130 may be located at the uphole end of the pulser assembly 26.

Referring to FIGS. 3 to 6 the first embodiment of the fluid pressure pulse generator 130 comprising stator 140, rotor 160 and rotor cap 190 is shown in more detail. The stator projections 142 are tapered and narrower at their proximal end attached to the stator body 141 than at their distal end. The stator projections 142 have a radial profile with an uphole end 146 and a downhole face 145, with two opposed side faces 147 and a distal end face 148 extending between the uphole end 146 and the downhole face 145. The stator projections 142 have a rounded uphole end 146 and the radial profile of the stator projections 142 tapers towards the rounded uphole end 146. Mud flowing along the external surface of the stator body 141 contacts the uphole end 146 of the stator projections 142 and flows through stator flow channels 143 defined by the side faces 147 of adjacently positioned stator projections 142. The stator flow channels 143 are curved or rounded at their proximal end closest to the stator body 141. The curved stator flow channels 143, as well as the tapered section and rounded uphole end 146 of the stator projections 142 may provide smooth flow of mud through the stator flow channels 143 and may reduce wear of the stator projections 142 caused by erosion. In alternative embodiments none or only some of the stator projections 142 may be tapered and the uphole end 146 may not be rounded. In alternative embodiments, the stator projections 142 and thus the stator flow channels 143 defined therebetween may be any shape and may be dimensioned to direct flow of mud through the stator flow channels 143.

The rotor projections 162 are equidistantly spaced around the downhole end of the rotor body 169 and are axially adjacent and downhole relative to the stator projections 142 in the assembled fluid pressure pulse generator 130. The rotor projections 162 have a radial profile with an uphole face 166 and a downhole face 165, with two opposed side faces 167 and a distal end face 161 extending between the uphole face 166 and the downhole face 165. The rotor projections 162 taper and are narrower at their proximal end attached to the rotor body 169 than at their distal end. Rotor flow channels 163 defined by side faces 167 of adjacent rotor projections 162 are curved or rounded at the proximal end closest to the rotor body 169 for smooth flow of mud therethrough which may reduce wear of the rotor projections 162. Positioning the stator projections 142 uphole of the rotor projections 162 may protect the rotor projections 162 from wear as they are protected from mud flow by the stator projections 142 when the rotor 160 is in the open flow position.

The rotor projections 162 have an angled rotor bypass channel comprising a cylindrical aperture 124 extending through the rotor projection 162 with an inlet 126 in the uphole face 166 and an outlet 125 in the downhole face 165 of the rotor projection 162. The outlet 125 is downhole and lateral relative to the inlet 126 and the apertures 124 are angled from right to left in the downhole direction. The apertures 124 are therefore angled relative to the direction of flow of mud through the stator flow channels 143 (i.e. the apertures 124 are angled relative to the longitudinal axis of the fluid pressure pulse generator 130). The inlet 126 and outlet 125 are circular and the walls of the apertures 124 taper towards the inlet 126, such that the diameter of the outlet 125 is greater than the diameter of the inlet 124. This may reduce or prevent debris or lost circulation material (LCM) build up in the apertures 124 which could plug the apertures 124 and restrict mud flow. In alternative embodiments, the inlet 126 and outlet 125 may be any shape and the apertures 124 may not be cylindrical or tapered. In further alternative embodiments, the apertures 124 may be angled the opposite way from left to right in the downhole direction.

In alternative embodiments, the rotor projections 162 may be positioned uphole of the stator projections 142; for example, the fluid pressure pulse generator 130 may be positioned at the uphole end of the pulser assembly 26 with the stator body 141 fixedly coupled with the uphole end of the pulser assembly housing 49 and the rotor projections 162 uphole and adjacent to the stator projections 142. In alternative embodiments, the rotor projections 162 may be any shape and dimensioned to be axially adjacent and rotatable relative to the stator projections 142, for example the rotor projections 162 may have a radial face at one of the uphole or downhole ends of the rotor projection 162 which is adjacent a radial face of the stator projections 142, and the other of the uphole or downhole ends of the rotor projections 162 may be tapered and rounded. In alternative embodiments, the inlet 126 of the apertures 124 may be on the uphole face 166 and the outlet 125 of the apertures 124 may be on one of the side faces 167 or the distal end face 161 of the rotor projections 162. When the rotor projections 162 are positioned uphole of the stator projections 142, the inlet of the apertures 124 may be on one of the side faces 167 or the distal end face 161 with the outlet of the apertures 124 on a downhole face of the rotor projections 162. In further alternative embodiments only one or a few of the rotor projections 162 may have angled apertures 124, and the rest of the rotor projections 162 may have no apertures or may have apertures or other bypass channels that are not angled relative to the direction of flow of mud through the stator flow channels 143. The innovative aspects apply equally in embodiments such as these.

During downhole operation of the MWD tool 20, a controller (not shown) in the electronics subassembly 28 sends motor control signals to a motor in the motor and gearbox subassembly 23 to rotate the driveshaft 24 and rotor 160 in a controlled pattern to generate pressure pulses 6. The rotor projections 162 align with the stator projections 142 when the rotor 160 is in the open flow position shown in FIG. 5 and mud flows relatively unrestricted through the stator flow channels 143 and rotor flow channels 163 with zero pressure. To generate a pressure pulse 6, the motor rotates the driveshaft 24 and rotor 160 to the restricted flow position shown in FIG. 6 where the rotor projections 162 align with the stator flow channels 143. In the restricted flow position, some mud flows through the angled apertures 124; however, the overall mud flow area is reduced when the rotor 160 is in the restricted flow position compared to the overall mud flow area when the rotor 160 is in the open flow position which increases mud pressure and results in pressure pulse 6. The rotor projections 162 rotate in and out of fluid communication with the stator flow channels 143 in a controlled pattern to generate pressure pulses 6 representing the carrier wave for transmission to surface.

Figure 7:
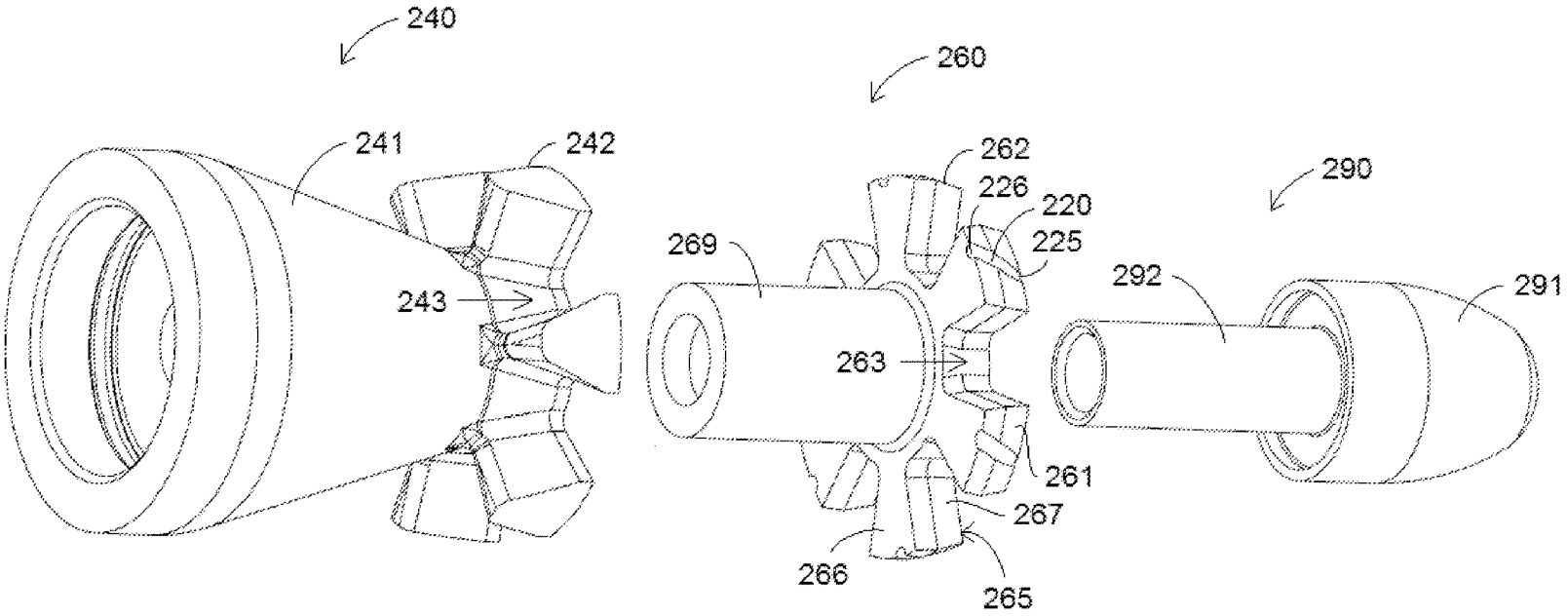
FIG. 7 is an exploded perspective view of a fluid pressure pulse generator according to a second embodiment comprising a stator, a rotor and a rotor cap.
Figure 8:
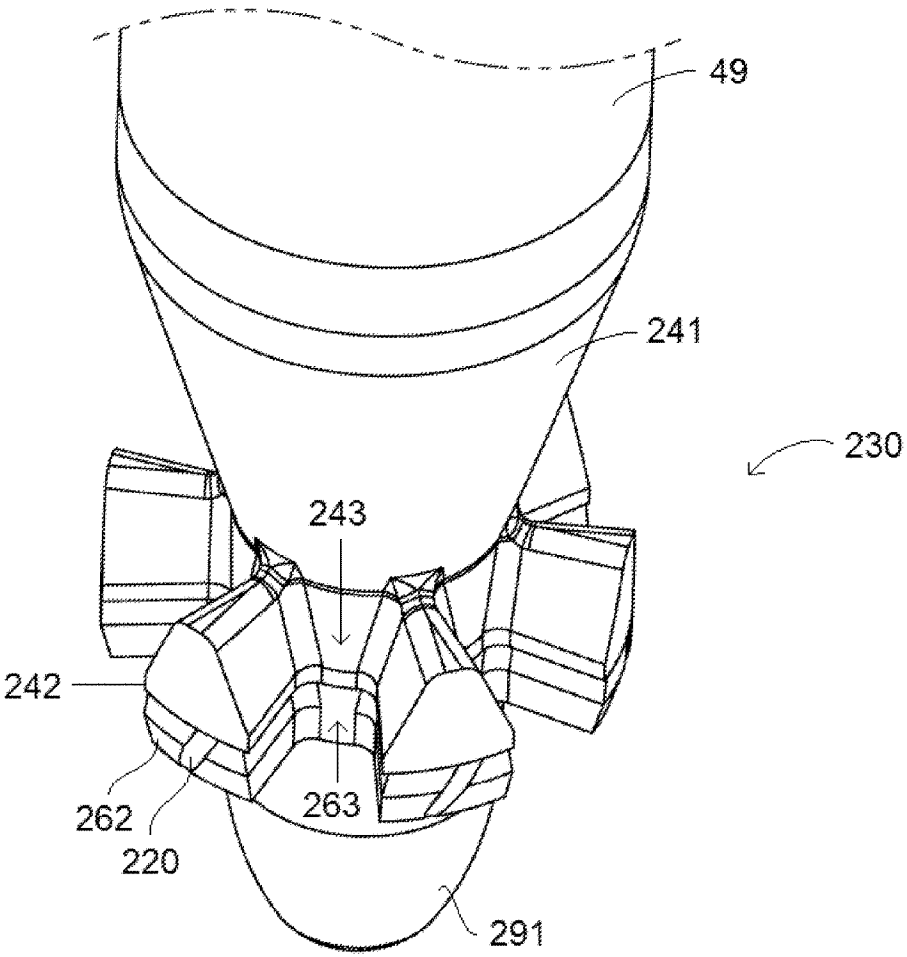
FIG. 8 is a perspective view of the downhole end the MWD tool showing the fluid pressure pulse generator of the second embodiment with the rotor in an open flow position.
Figure 9:
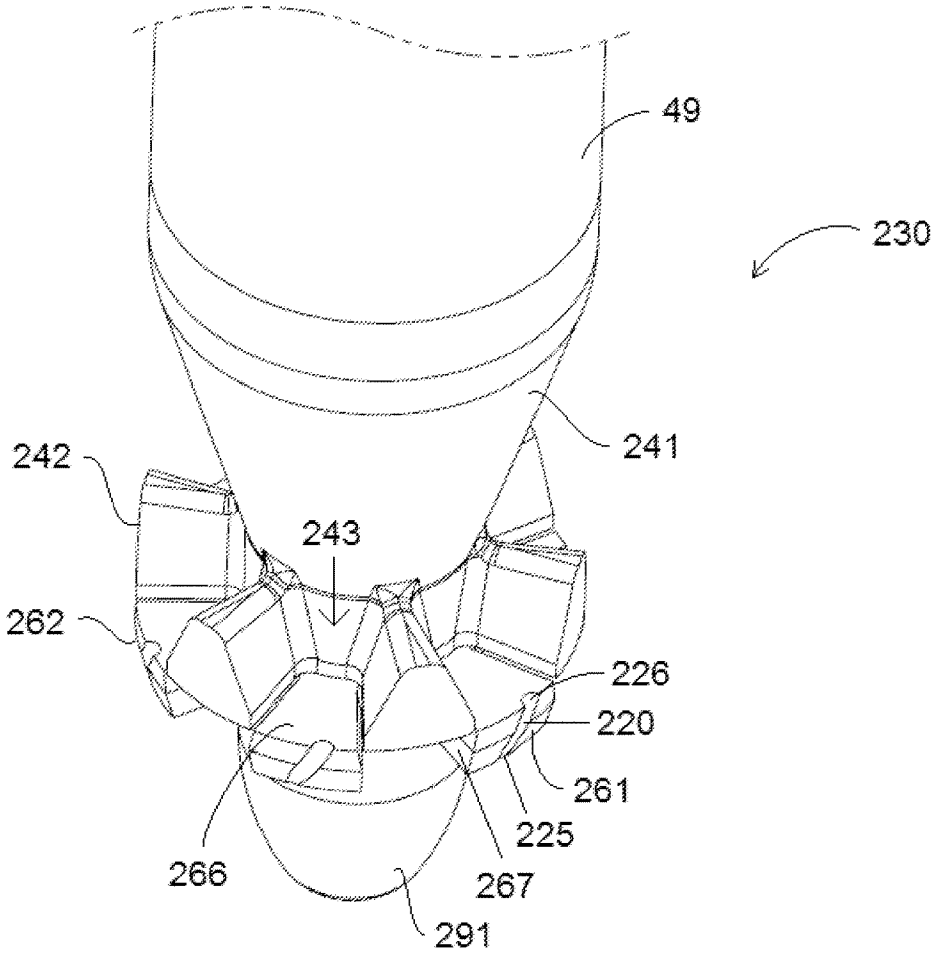
FIG. 9 is a perspective view of the downhole end the MWD tool showing the fluid pressure pulse generator of the second embodiment with the rotor in a restricted flow position.

Referring now to FIGS. 7 to 9 there is shown a fluid pressure pulse generator 230 according to a second embodiment comprising stator 240, rotor 260 and rotor cap 290. Stator 240 is similar to stator 140 of the first embodiment of the fluid pressure pulse generator 130 and comprises a longitudinally extending stator body 241 with a central bore therethrough and a plurality of radially extending stator projections 242 spaced equidistant around the downhole end of the stator body 241. The stator projections 242 define stator flow channels 243 therebetween.

The rotor 260 comprises a rotor body 269 with a central bore therethrough and a plurality of radially extending rotor projections 262 spaced equidistant around the downhole end of the rotor body 269. A coupling key receptacle (not shown) receives coupling key 30 which extends through downhole driveshaft portion 24*a* to couple the driveshaft 24 with the rotor body 269 as described above with reference to FIGS. 2 to 6. The rotor projections 262 have a radial profile with an uphole face 266 and a downhole face 265, with two opposed side faces 267 and a distal end face 261 extending between the uphole face 266 and the downhole face 265. Rotor flow channels 263 are defined by side faces 267 of adjacent rotor projections 262.

In alternative embodiments, the rotor projections 262 may be positioned uphole of the stator projections 242; for example, the fluid pressure pulse generator 230 may be positioned at the uphole end of the pulser assembly 26 with the stator body 241 coupled with the uphole end of the pulser assembly housing 49 and the rotor projections 262 uphole and adjacent to the stator projections 242. In alternative embodiments, the rotor projections 262 may be any shape and dimensioned to be axially adjacent and rotatable relative to the stator projections 242, for example the rotor projections 262 may have a radial face at one of the uphole or downhole ends of the rotor projection 262 which is adjacent a radial face of the stator projections 242, and the other of the uphole or downhole ends of the rotor projections 262 may be tapered and/or rounded.

The rotor projections 262 have an angled rotor bypass channel comprising a groove 220 extending along the distal end face 261 with an inlet 226 at the uphole face 266 and an outlet 225 at the downhole face 265 of the rotor projection 262. In alternative embodiments the outlet 225 may be at one of the side faces 267. In further alternative embodiments, when the rotor projections 262 are positioned uphole of the stator projections 242, the inlet of the groove 220 may be at one of the side faces 267 with the outlet of the groove 220 at a downhole face of the rotor projections 262. The outlet 225 is downhole and lateral relative to the inlet 226 and the grooves 220 are angled from right to left in the downhole direction. The grooves 220 are therefore angled relative to the direction of flow of mud through the stator flow channels 243 (i.e. the grooves 220 are angled relative to the longitudinal axis of the fluid pressure pulse generator 230). The grooves 220 may be less likely to become clogged with debris or LCM than the apertures 124 of the first embodiment of the fluid pressure pulse generator 130 shown in FIGS. 3 to 8. The semi-circular geometry of the grooves 220 may reduce erosion caused by mud compared to geometries that have corners; however, in alternative embodiments, the grooves 220 may be any shape and may be tapered. In alternative embodiments, the grooves 220 may be angled the opposite way from left to right in the downhole direction. In further alternative embodiments only one or some of the rotor projections 262 may have angled grooves 220, and the rest of the rotor projections 262 may have no grooves or may have grooves or other bypass channels that are not angled relative to the direction of flow of mud through the stator flow channels 243. In further alternative embodiments, the rotor projections 262 may include angled apertures 124 in addition to the angled grooves 220 or some rotor projections 262 may include angled apertures 124 and some rotor projections 262 may include angled grooves 220. The innovative aspects apply equally in embodiments such as these.

Rotor cap 290 is similar to rotor cap 190 of the first embodiment of the fluid pressure pulse generator 130 and comprising a cap body 291 and a cap shaft 292. The cap shaft 292 releasably couples the rotor body 269 to the driveshaft 24 of the MWD tool 20 as described above in more detail with reference to FIG. 2.

The rotor projections 262 align with the stator projections 242 when the rotor 260 is in the open flow position shown in FIG. 8 and mud flows unrestricted through the stator flow channels 243 and rotor flow channels 263 with zero pressure. To generate a pressure pulse 6, the motor rotates the driveshaft 24 and rotor 260 to the restricted flow position shown in FIG. 9 where the rotor projections 262 align with the stator flow channels 243. In the restricted flow position, some mud flows through the angled grooves 220; however, the overall mud flow area is reduced when the rotor 260 is in the restricted flow position compared to the overall mud flow area when the rotor 260 is in the open flow position which increases mud pressure and results in pressure pulse 6. The rotor projections 262 rotate in and out of fluid communication with the stator flow channels 243 in a controlled pattern to generate pressure pulses 6 representing the carrier wave for transmission to surface.

The angled rotor bypass channels (e.g. apertures 124 and/or grooves 220) provide a self correction mechanism to rotate the rotor 160, 260 towards the open flow position if there is failure of the motor and gearbox subassembly 23, driveshaft 24 or any other component of the MWD tool 20 that results in rotation of the rotor 160, 260 stopping during downhole operation. More specifically, if the pulser assembly 26 fails when the rotor 160, 260 is in the restricted flow position, or is transitioning between the open and restricted flow positions and the angled apertures 124 or the angled grooves 220 are in fluid communication with the stator flow channels 143, 243, mud flowing through and discharging from the angled rotor bypass channels causes the rotor projections 162, 262 to rotate towards the open flow position until the angled apertures 124 or the angled grooves 220 are no longer in fluid communication with the stator flow channels 143, 243. In the first embodiment of the fluid pressure pulse generator 130 shown in FIGS. 3 to 6 the apertures 124 are angled from right to left in the downhole direction such that mud flowing through the apertures 124 causes clockwise rotation of the rotor 160 towards the open flow position. In alternative embodiments, the apertures 124 may be angled in the opposite direction from left to right in the downhole direction causing counter-clockwise rotation of the rotor 160 towards the open flow position. In the second embodiment of the fluid pressure pulse generator 230 shown in FIGS. 7 to 9 the grooves 220 are angled from right to left in the downhole direction such that mud flowing through the grooves 220 causes clockwise rotation of the rotor 260 towards the open flow position. In alternative embodiments, the grooves 220 may be angled in the opposite direction from left to right in the downhole direction causing counter-clockwise rotation of the rotor 260 towards the open flow position. In alternative embodiments, only a portion of the rotor bypass channel (e.g. aperture 124 or groove 220) may be angled with the remainder of the rotor bypass channel extending along the longitudinal axis of the fluid pressure pulse generator 130, 230.

Figure 5:
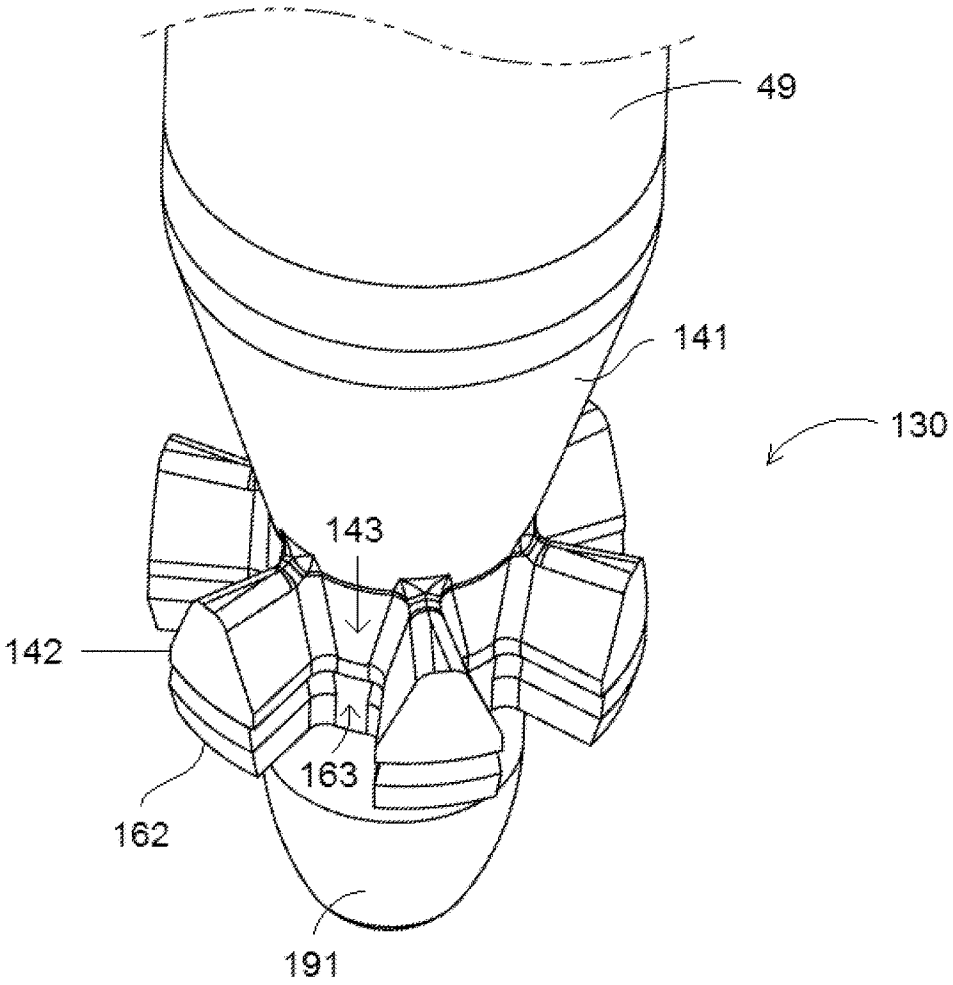
FIG. 5 is a perspective view of the downhole end of the MWD tool showing the fluid pressure pulse generator of the first embodiment with the rotor in an open flow position.
Figure 6:
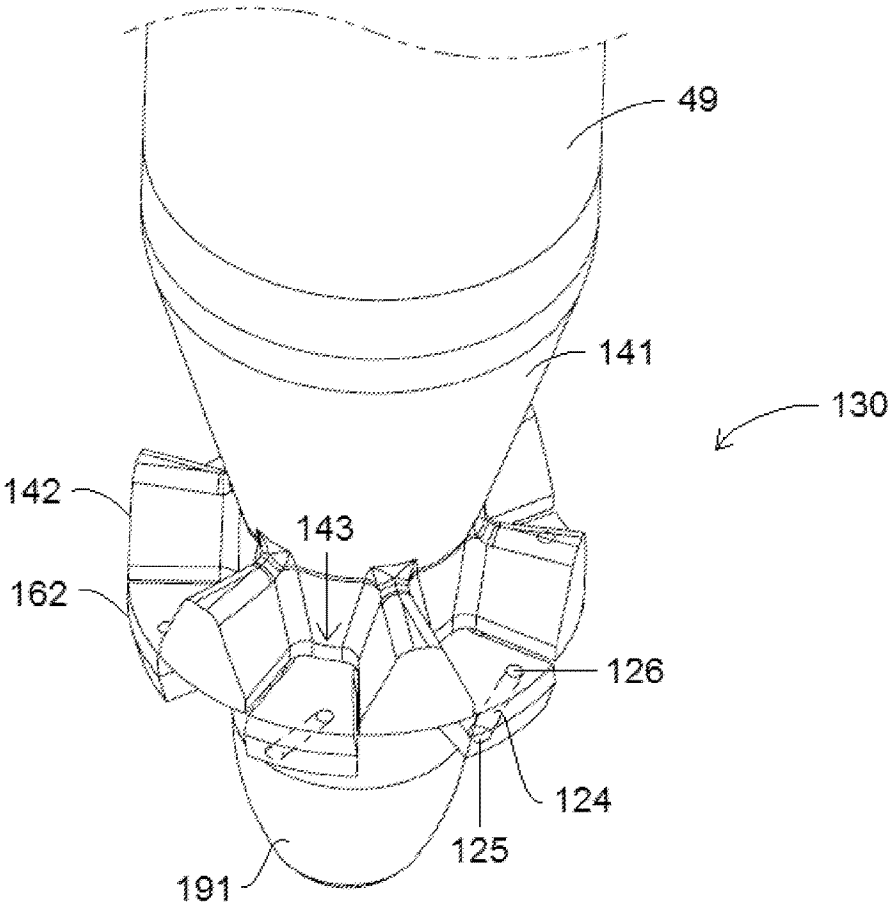
FIG. 6 is a perspective view of the downhole end of the MWD tool showing the fluid pressure pulse generator of the first embodiment with the rotor in a restricted flow position and the angled apertures shown as dashed lines extending through the rotor projections.

When the first embodiment of the fluid pressure pulse generator 130 is positioned at the downhole end of the pulser assembly 26, the rotor projections 162 are downhole of the stator projections 142 and the inlet 126 of the angled apertures 124 is below the stator projections 142 when the rotor 160 is in the open flow position shown in FIG. 5. Similarly, when the second embodiment of the fluid pressure pulse generator 230 is positioned at the downhole end of the pulser assembly 26, the rotor projections 262 are downhole of the stator projections 242 and the inlet 226 of the angled grooves 220 is below the stator projections 242 when the rotor 260 is in the open flow position shown in FIG. 8.

When the first embodiment of the fluid pressure pulse generator 130 is positioned at the uphole end of the pulser assembly 26, the stator projections 142 are downhole of the rotor projections 162 and block the outlet of the angled apertures 124 when the rotor 160 is in the open flow position. Similarly, when the second embodiment of the fluid pressure pulse generator 230 is positioned at the uphole end of the pulser assembly 26, the stator projections 242 are downhole of the rotor projections 262 and block the outlet of the angled grooves 220 when the rotor 260 is in the open flow position.

The MWD tool 20 may include a mechanical stop mechanism, such as (but not limited to) the mechanical stop mechanism disclosed in U.S. Patent Application 62/440,012 or International Publication WO 2014/071519 (incorporated herein by reference). The mechanical stop mechanism may be included in the tool to prevent further rotation of the rotor beyond the open flow position when there is failure of the MWD tool 20.

Rotation of the rotor 160, 260 towards the open flow position when there is failure of the MWD tool 20 may reduce blockage and mud pressure build up caused by the rotor 160, 260 being held in the restricted flow position for an extended period of time. Without self-correction, the pressure build up may lead to damage of the rotor 160, 260 and/or stator 140, 240 or other parts of the MWD tool 20. The pressure build up may also lead to failure of the pumps or piping on surface. Furthermore, movement of the rotor 160, 260 towards the open flow position may reduce or prevent debris or lost circulation material (LCM) build up which could plug the drill collar 27 and restrict mud flow. The angled rotor bypass channels may also reduce the torque required to rotate the rotor 160, 260 during normal operation and this may reduce the power needed to rotate the rotor 160, 260 to generate pressure pulses 6.

In alternative embodiments the fluid pressure pulse generator may be any fluid pressure pulse generator that has stator projections with stator flow channels therebetween and rotor projections that are axially adjacent and rotatable relative to the stator projections such that the rotor projections move in and out of fluid communication with the stator flow channels to create fluid pressure pulses in fluid flowing through the stator flow channels. For example, the fluid pressure pulse generator may be a dual height pressure pulse generator as described in WO 2015/196289 (incorporated herein by reference) where the rotor rotates in one direction from the open flow (start) position to a partial restricted flow position and in the opposite direction to a full restricted flow position to respectively generate a partial and full pressure pulse, with the partial pressure pulse being reduced compared to the full pressure pulse.

The angled rotor bypass channel may be any channel extending through at least one of the rotor projections or along a surface of at least one of the rotor projections with a fluid inlet and a fluid outlet. The fluid outlet is downhole and lateral relative to the fluid inlet such that mud flowing along the angled rotor bypass channel when the angled rotor bypass channel is in fluid communication with the stator flow channels causes rotation of the rotor towards the open flow position. The mud flowing along the angled rotor bypass channel and discharging from the fluid outlet may have a vector with at least a lateral component and a longitudinal component. The mud being discharged may also have a radial component.

Figure 10:
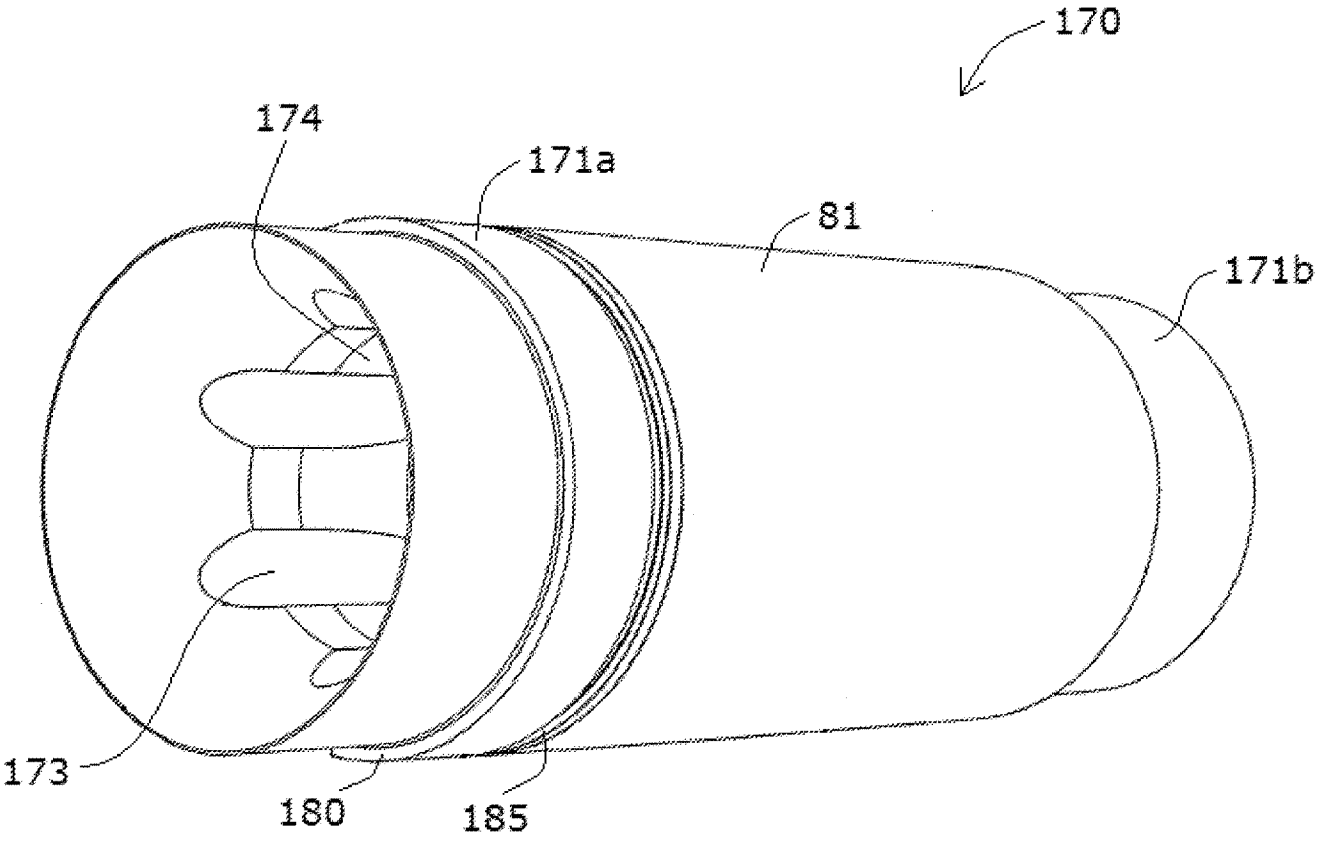
FIG. 10 is a perspective view of the flow bypass sleeve of the first embodiment.
Figure 11:
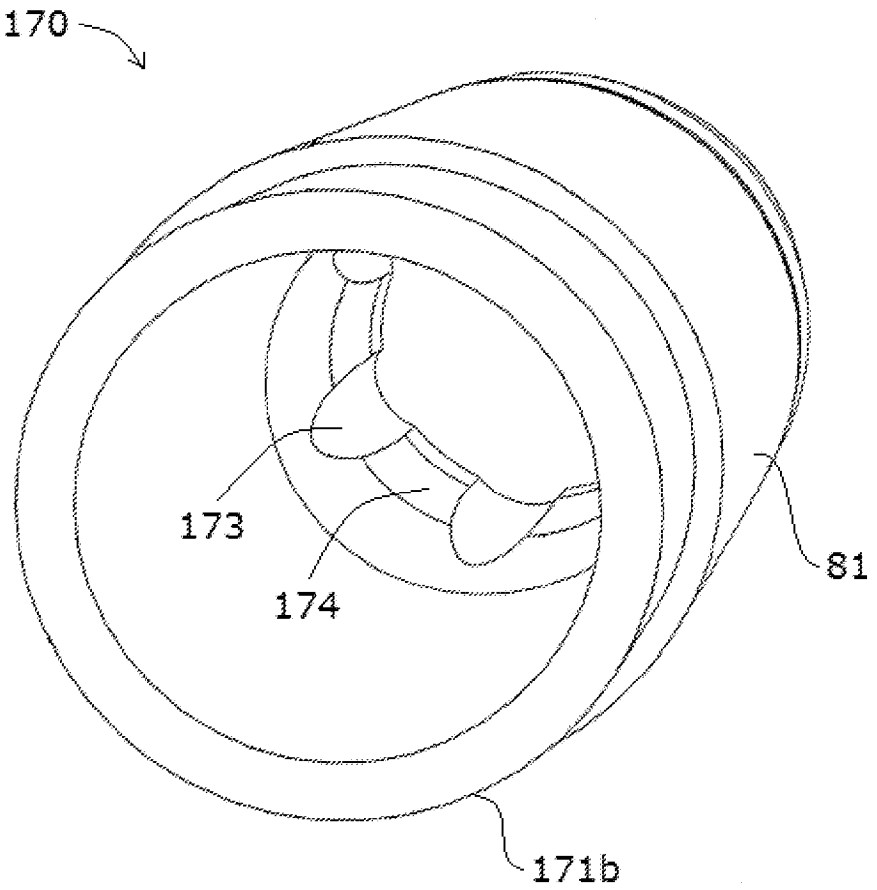
FIG. 11 is a perspective view of the downhole end of the flow bypass sleeve of the first embodiment.
Figure 12:
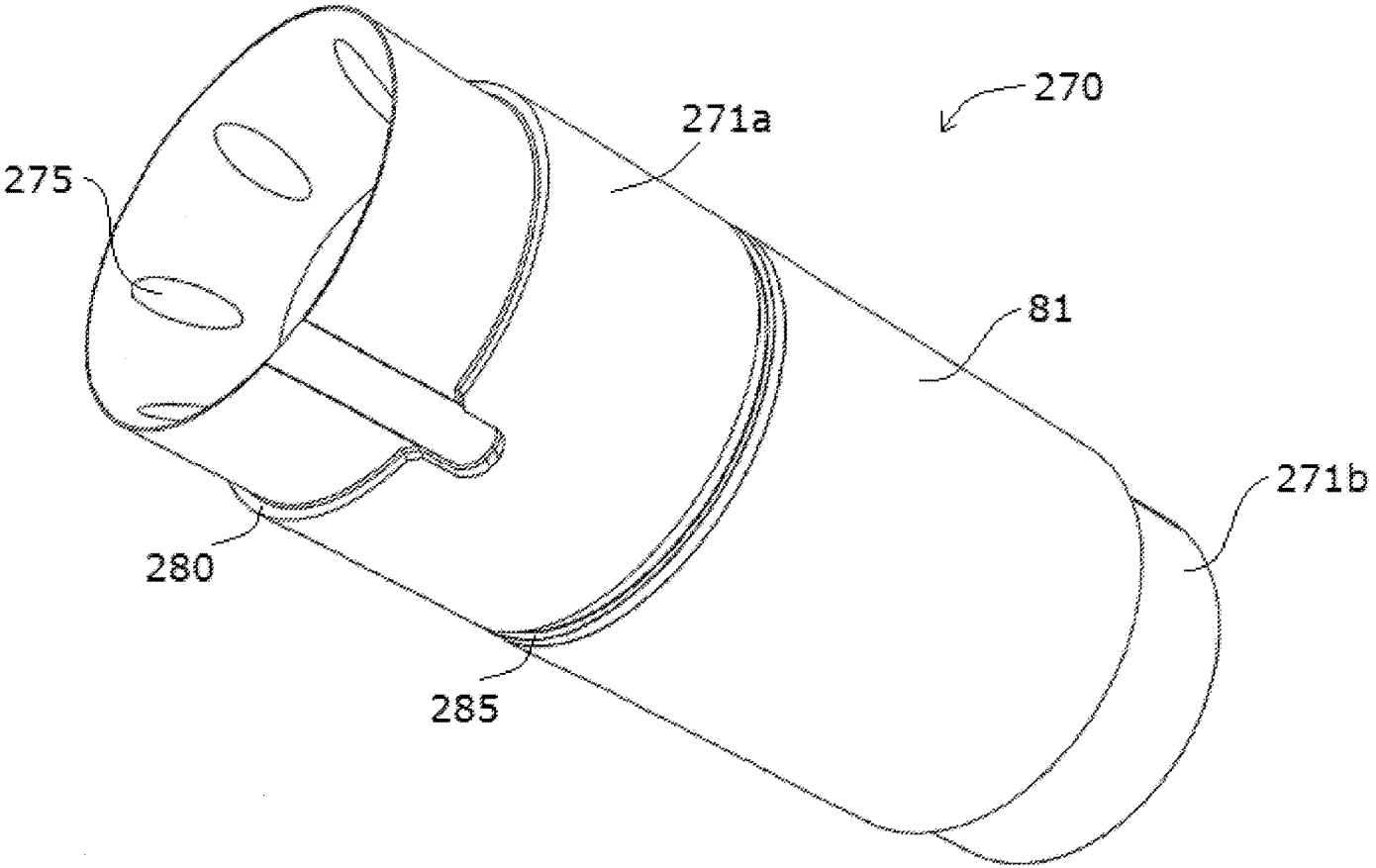
FIG. 12 is a perspective view of a second embodiment of a flow bypass sleeve.
Figure 13:
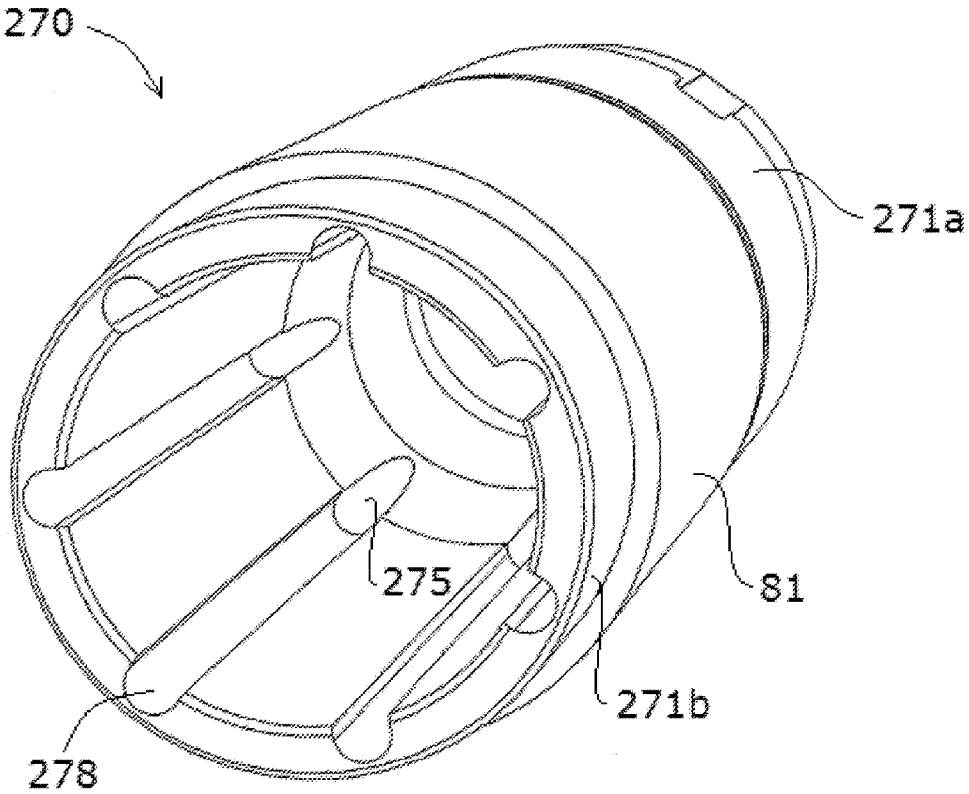
FIG. 13 is a perspective view of the downhole end of the flow bypass sleeve of the second embodiment.

Referring now to FIGS. 10 and 11 there is shown the first embodiment of the flow bypass sleeve 170 comprising a generally cylindrical sleeve body with a central bore therethrough made up of an uphole body portion 171*a*, a downhole body portion 171*b* and a lock down sleeve 81. Referring to FIGS. 12 and 13 a second embodiment of a flow bypass sleeve 270 is shown comprising a generally cylindrical sleeve body with a central bore therethrough made up of an uphole body portion 271*a*, a downhole body portion 271*b* and lock down sleeve 81.

Figure 14:
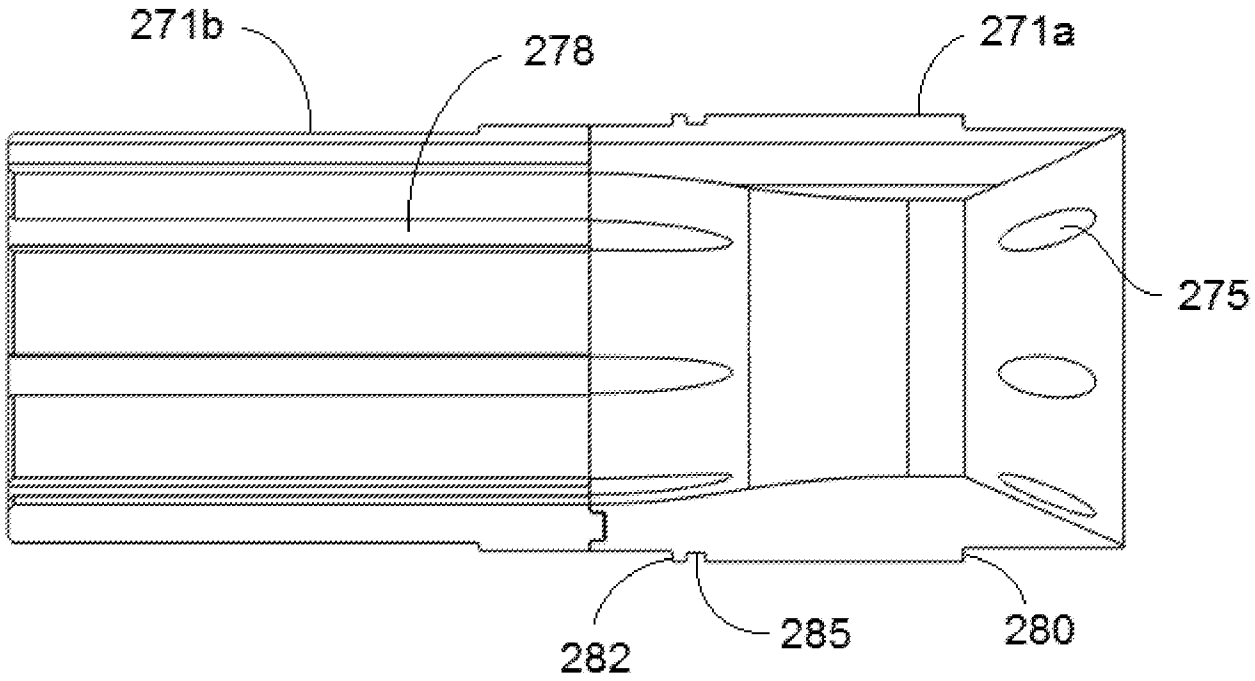
FIG. 14 is a side sectioned view of an uphole body portion and a downhole body portion of the flow bypass sleeve of the second embodiment, with the uphole and downhole body portions fitted together.

During assembly of the second embodiment of the flow bypass sleeve 270, the uphole body portion 271*a* and downhole body portion 271*b* are axially aligned and fitted together as shown in FIG. 14. Lock down sleeve 81 is slid over the downhole end of the downhole body portion 271*b* and moved towards the uphole body portion 271*a* until the uphole edge of the lock down sleeve 81 abuts an annular shoulder 282 on the external surface of uphole body portion 271*a*. Similarly, during assembly of the first embodiment of the flow bypass sleeve 170, the uphole body portion 171*a* and downhole body portion 171*b* are axially aligned and locked together by the lock down sleeve 81. The assembled flow bypass sleeve 170, 270 can then be inserted into the downhole end of drill collar 27. The external surface of uphole body portion 171*a*, 271*a* includes an annular shoulder 180, 280 near the uphole end of uphole body portion 171*a*, 271*a* which abuts a downhole shoulder of a keying ring (not shown) that is press fitted into the drill collar 27. A threaded ring (not shown) fixes the flow bypass sleeve 170, 270 within the drill collar 27. A groove 185, 285 on the external surface of the uphole body portion 171*a*, 271*a* receives an o-ring (not shown) and a rubber back-up ring (not shown) such as a parbak to help seat the flow bypass sleeve 170, 270 and reduce fluid leakage between the flow bypass sleeve 170, 270 and the drill collar 27. In alternative embodiments the flow bypass sleeve 170, 270 may be assembled or fitted within the drill collar 27 using alternative fittings as would be known to a person of skill in the art.

As shown in FIG. 2, the diameter of the bore through the sleeve body is smallest at a central section 177 which surrounds the stator projections 142 and rotor projections 162. The outer diameter of the stator projections 142 may be dimensioned such that the stator projections 142 contact the internal surface of the central section 177 of the sleeve body. The outer diameter of the rotor projections 162 is slightly less than the internal diameter of the central section 177 of the sleeve body to allow rotation of the rotor projections 162 relative to the sleeve body. The bore through the sleeve body gradually increases in diameter from the central section 177 towards the downhole end of the sleeve body to define an internally tapered downhole section 176. The bore through the sleeve body also increases in diameter from the central section 177 towards the uphole end of the sleeve body to define an internally tapered uphole section 179 of sleeve body. The taper of the uphole section 179 is greater than the taper of downhole section 176 of sleeve body. The uphole section 179 of sleeve body surrounds the frusto-conical section of stator body 141 with the annular channel 56 extending therebetween. The downhole section 176 of the sleeve body surrounds the rotor cap body 191.

In the first embodiment of the flow bypass sleeve 170, the internal surface of the uphole body portion 171*a* includes a plurality of longitudinal extending grooves 173. Grooves 173 are equidistantly spaced around the internal surface of the uphole body portion 171*a*. The flow bypass sleeve 170 may be used with both the first and second embodiments of the fluid pressure pulse generator 130, 230 and internal walls 174 in-between each groove 173 align with the stator projections 142, 242 of the fluid pressure pulse generator 130, 230 and the grooves 173 align with the stator flow channels 143, 243. The flow bypass sleeve 170 may be precisely located with respect to the drill collar 27 using a keying notch (not shown) to ensure correct alignment of the stator projections 142, 242 with the internal walls 174. The rotor projections 162, 262 rotate relative to the flow bypass sleeve 170 as the rotor 160 moves between the open flow position and the restricted flow position as described above in more detail.

In the second embodiment of the flow bypass sleeve 270 a plurality of apertures 275 extend longitudinally through the uphole body portion 271*a*. The apertures 275 are cylindrical and equidistantly spaced around uphole body portion 271*a*. The internal surface of the downhole body portion 271*b* includes a plurality of spaced grooves 278 which align with the apertures 275 in the assembled flow bypass sleeve 270 (shown in FIGS. 13 and 14), such that mud is channelled through the apertures 275 and into grooves 278. The second embodiment of the flow bypass sleeve 270 may be used with both the first and second embodiments of the fluid pressure pulse generator 130, 230. As the internal wall of the uphole body portion 271*a* of the flow bypass sleeve 270 is uniform, there is no need for precise alignment of the flow bypass sleeve 270 with respect to the stator projections 142, 242 of the fluid pressure pulse generator 130, 230.

Figure 15:
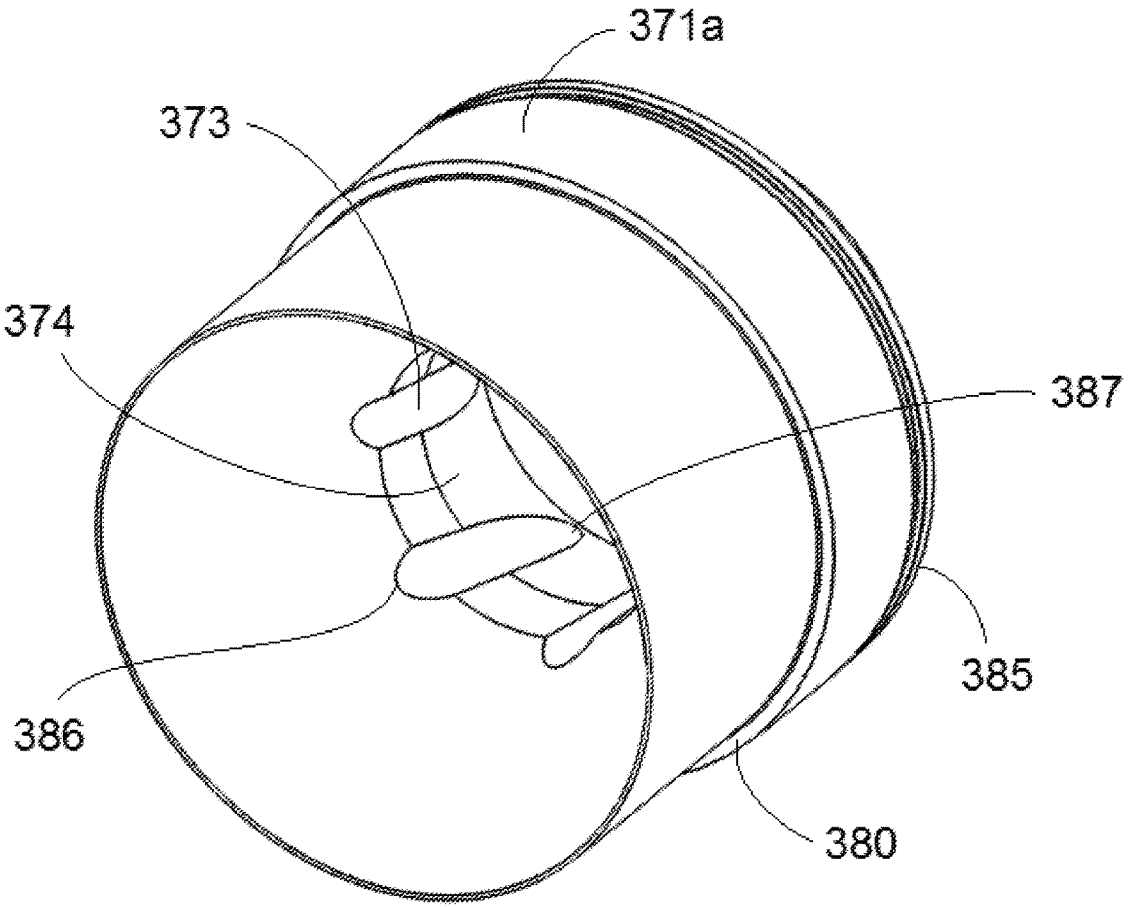
FIG. 15 is a perspective view of an uphole body portion of a third embodiment of a flow bypass sleeve.
Figure 16:
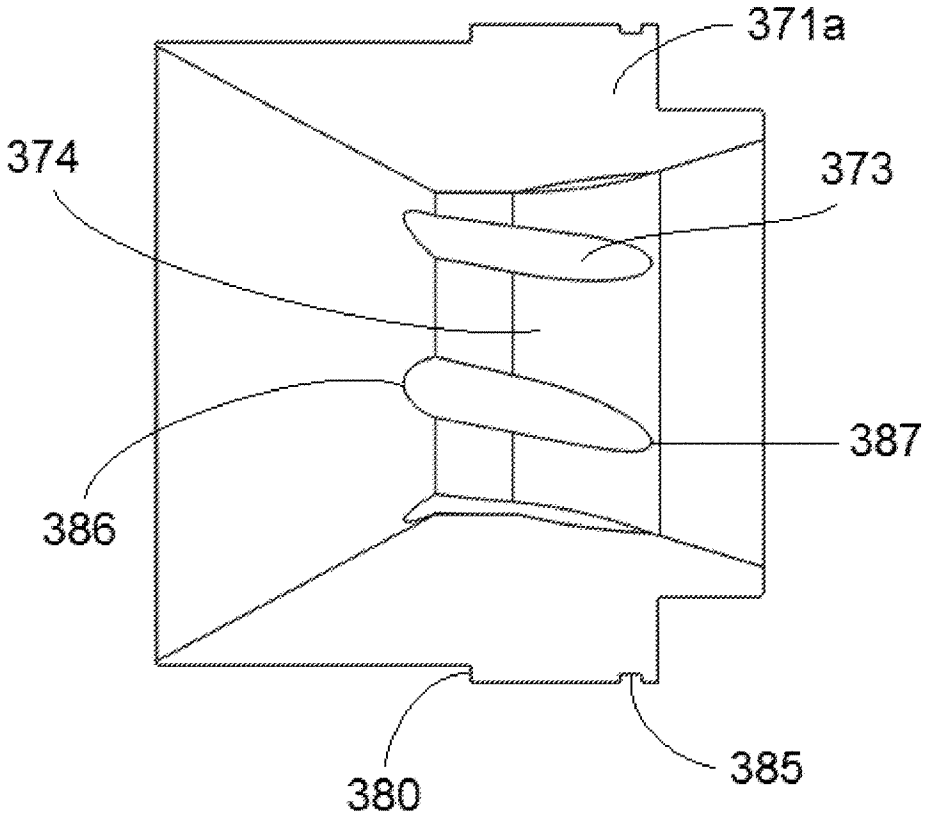
FIG. 16 is a side sectioned view of the uphole body portion of the flow bypass sleeve of the third embodiment.
Figure 17:
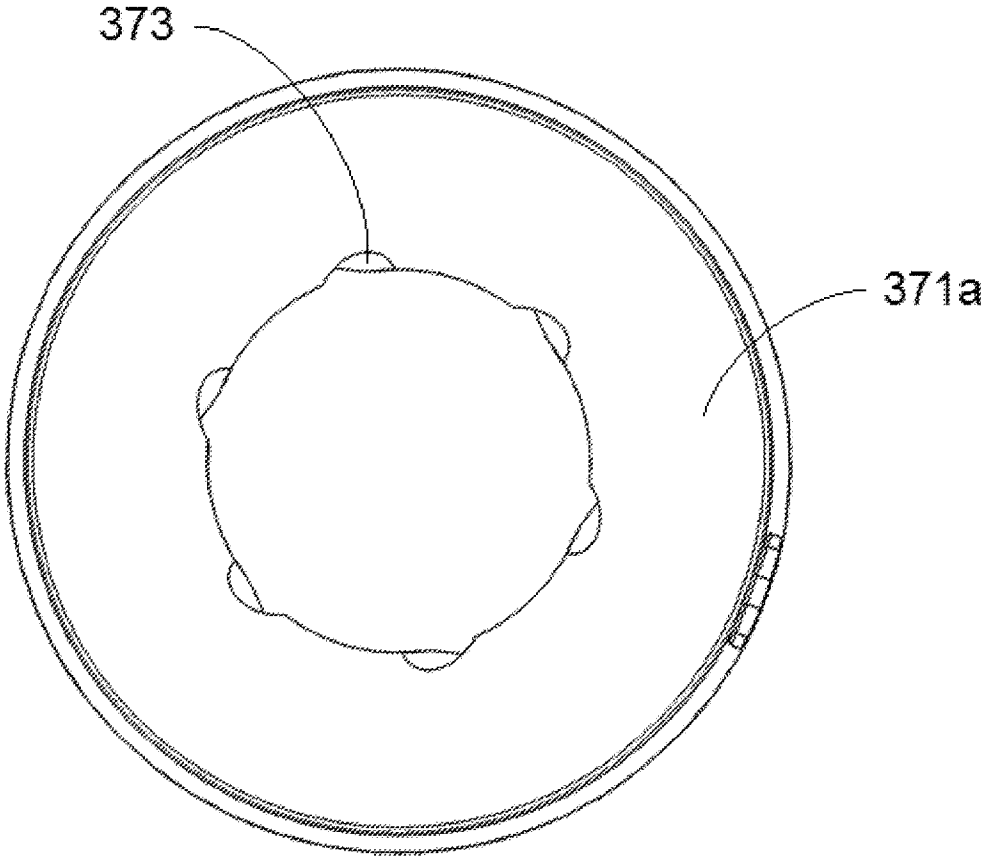
FIG. 17 is an end view of the uphole body portion of the flow bypass sleeve of the third embodiment.

Referring now to FIGS. 15 to 17 there is shown an uphole body portion 371*a* of a third embodiment of a flow bypass sleeve. The uphole body portion 371*a* may be axially aligned and fitted to downhole body portion 171*b* shown in FIGS. 10 and 11. The uphole body portion 371*a* and downhole body portion 171*b* may be joined by lock down sleeve 81 to form the assembled flow bypass sleeve of the third embodiment before being inserted into the downhole end of drill collar 27 as described above with reference to FIGS. 10 and 11. The uphole body portion 371*a* includes an annular shoulder 380 which abuts a downhole shoulder of a keying ring (not shown) that is press fitted into the drill collar 27 and a groove 385 on the external surface of the uphole body portion 371*a* receives an O-ring (not shown) and a rubber back-up ring (not shown) such as a parbak to help seat the flow bypass sleeve of the third embodiment and reduce fluid leakage between the flow bypass sleeve and the drill collar 27 as described above with reference to FIGS. 10 and 11.

In the third embodiment of the flow bypass sleeve, the internal surface of the uphole body portion 371*a* includes a plurality of longitudinal extending angled sleeve bypass channels comprising grooves 373. The angled grooves 373 have a fluid inlet 386 and a fluid outlet 387 and are equidistantly spaced around the internal surface of the uphole body portion 371*a*. The outlet 387 is downhole and lateral relative to the inlet 386 and the grooves 373 are angled from right to left in the downhole direction. In alternative embodiments (not shown), the grooves 373 may be angled from left to right in the downhole direction. In further alternative embodiments, only some of the grooves 373 may be angled and the remainder may extend parallel to the longitudinal axis of the flow bypass sleeve.

The third embodiment of the flow bypass sleeve may be used with both the first and second embodiments of the fluid pressure pulse generator 130, 230. Internal walls 374 in-between adjacent angled grooves 373 align with the stator projections 142, 242 of the fluid pressure pulse generator 130, 230 and the angled grooves 373 align with the stator flow channels 143, 243. The uphole body portion 371*a* of the flow bypass sleeve may be precisely located with respect to the drill collar 27 using a keying notch (not shown) to ensure correct alignment of the stator projections 142, 242 with the internal walls 374. The rotor projections 162, 262 rotate relative to the uphole body portion 371*a* as the rotor 160, 260 moves between the open flow position and the restricted flow position as described above in more detail. In the open flow position, the rotor projections 162, 262 align with the internal walls 374 and in the restricted flow position, the rotor projections 162, 262 align with the angled grooves 373.

Figure 18A:
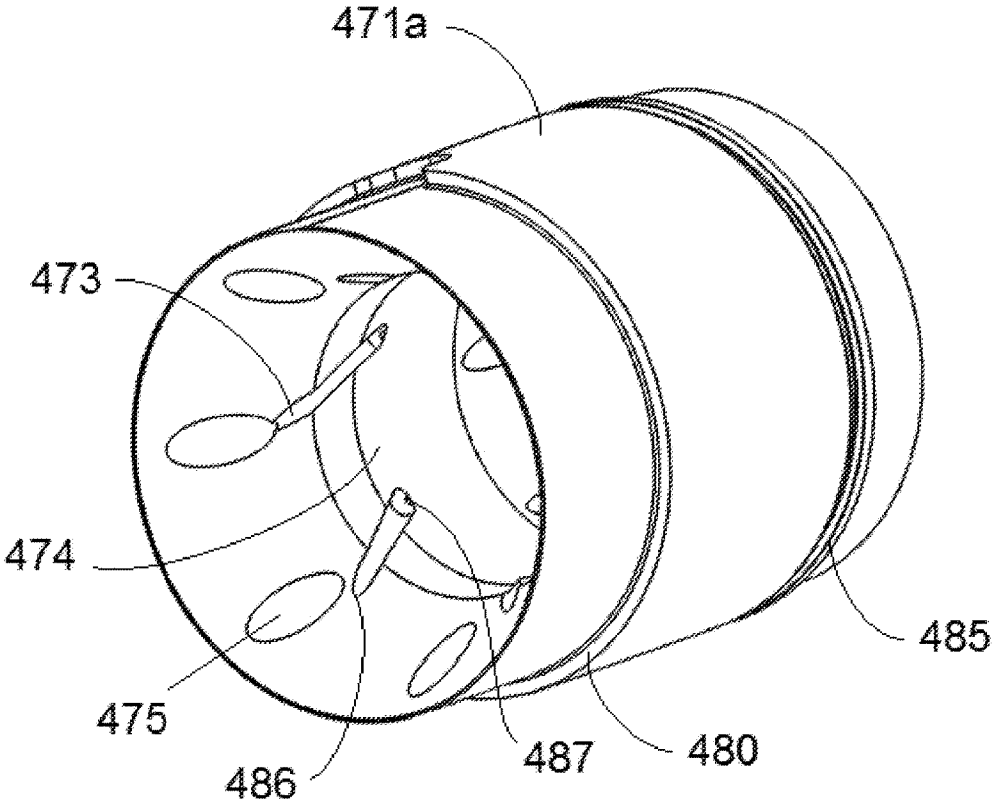
FIG. 18*a* is a perspective view of an uphole body portion of a fourth embodiment of a flow bypass sleeve.
Figure 18B:
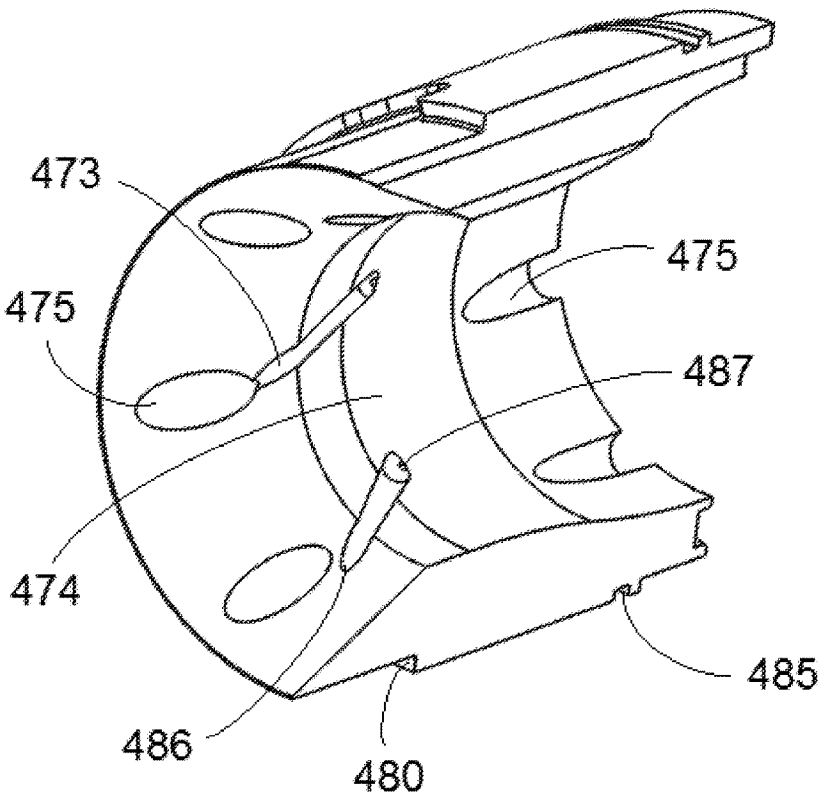
FIG. 18*b* is a sectioned view of FIG. 18*a*.
Figure 19:
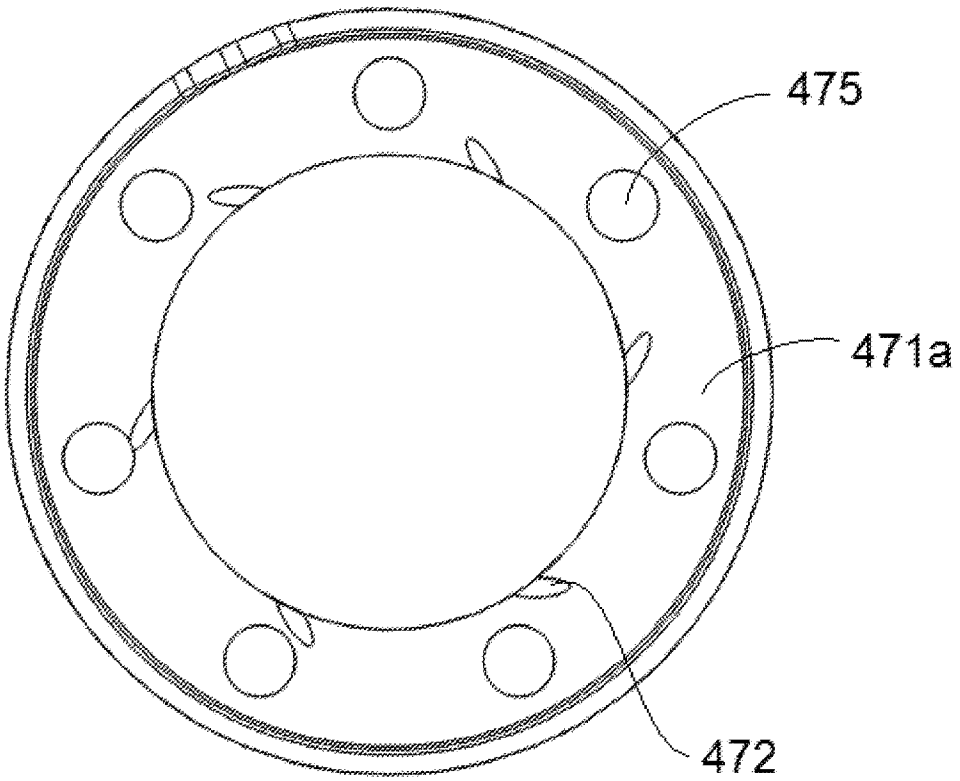
FIG. 19 is an end view of the uphole body portion of the flow bypass sleeve of the fourth embodiment.

Referring now to FIGS. 18 and 19 there is shown an uphole body portion 471*a* of a fourth embodiment of a flow bypass sleeve. The uphole body portion 471*a* may be axially aligned and fitted to downhole body portion 271*b* shown in FIGS. 12 to 14. The uphole body portion 471*a* and downhole body portion 271*b* may be joined by lock down sleeve 81 to form the assembled flow bypass sleeve of the fourth embodiment before being inserted into the downhole end of drill collar 27 as described above with reference to FIGS. 12 to 14. The uphole body portion 471*a* includes an annular shoulder 480 which abuts a downhole shoulder of a keying ring (not shown) that is press fitted into the drill collar 27 and a groove 485 on the external surface of the uphole body portion 471*a* receives an O-ring (not shown) and a rubber back-up ring (not shown) such as a parbak to help seat the flow bypass sleeve of the fourth embodiment and reduce fluid leakage between the flow bypass sleeve and the drill collar 27 as described above with reference to FIGS. 12 to 14.

In the fourth embodiment of the flow bypass sleeve a plurality of apertures 475 extend longitudinally through the uphole body portion 471*a*. The apertures 475 are circular and equidistantly spaced around uphole body portion 471*a*. The apertures 475 may align with spaced grooves 278 on the internal surface of the downhole body portion 271*b* in the assembled flow bypass sleeve of the fourth embodiment, such that mud is channelled through the apertures 475 and into grooves 278. The internal surface of the uphole body portion 471*a* includes a plurality of longitudinal extending angled sleeve bypass channels comprising grooves 473. The angled grooves 473 have a fluid inlet 486 and a fluid outlet 487 and are equidistantly spaced around the internal surface of the uphole body portion 471*a*. The outlet 487 is downhole and lateral relative to the inlet 486 and the grooves 473 are angled from right to left in the downhole direction. In alternative embodiments (not shown), the grooves 473 may be angled from left to right in the downhole direction. In further alternative embodiments, only some of the grooves 473 may be angled and the remainder may extend parallel to the longitudinal axis of the flow bypass sleeve.

The fourth embodiment of the flow bypass sleeve may be used with both the first and second embodiments of the fluid pressure pulse generator 130, 230. Internal walls 474 in-between adjacent angled grooves 473 align with the stator projections 142, 242 of the fluid pressure pulse generator 130, 230 and the angled grooves 473 align with the stator flow channels 143, 243. The uphole body portion 471*a* of the flow bypass sleeve of the fourth embodiment may be precisely located with respect to the drill collar 27 using a keying notch (not shown) to ensure correct alignment of the stator projections 142, 242 with the internal walls 474. The rotor projections 162, 262 rotate relative to the uphole body portion 471*a* of the flow bypass sleeve as the rotor 160, 260 moves between the open flow position and the restricted flow position as described above in more detail. In the open flow position, the rotor projections 162, 262 align with the internal walls 474 and in the restricted flow position, the rotor projections 162, 262 align with the angled grooves 473.

In alternative embodiments the flow bypass sleeve of the third and fourth embodiment may be used with any fluid pressure pulse generator that has stator projections with stator flow channels therebetween and rotor projections that are axially adjacent and rotatable relative to the stator projections such that the rotor projections move in and out of fluid communication with the stator flow channels to create fluid pressure pulses in fluid flowing through the stator flow channels. The rotor projections need not have angled rotor bypass channels as with the rotor projections 162, 262 of the first and second embodiment of the fluid pressure pulse generator 130, 230. For example, the fluid pressure pulse generator may be a dual height pressure pulse generator as described in WO 2015/196289 (incorporated herein by reference) where the rotor rotates in one direction from the open flow (start) position to a partial restricted flow position and in the opposite direction to a full restricted flow position to respectively generate a partial and full pressure pulse, with the partial pressure pulse being reduced compared to the full pressure pulse.

In alternative embodiments, the sleeve body may not be made up of an uphole body portion and a downhole body portion and may instead be a single unitary sleeve body. The lock down sleeve 81 may or may not be present in the assembled flow bypass sleeve.

Inclusion of an angled sleeve bypass channel, such as angled grooves 373, 473 of the flow bypass sleeve of the third and fourth embodiment, provides a self-correction mechanism to rotate the rotor towards the open flow position if there is failure of the MWD tool that results in rotation of the rotor stopping during downhole operation. More specifically, if the MWD tool fails when the rotor is in the restricted flow position, or is transitioning between the open and restricted flow positions and the rotor projections are in fluid communication with the angled sleeve bypass channel, mud flowing through and discharging from the angled sleeve bypass channel causes the rotor to rotate towards the open flow position. Rotation of the rotor towards the open flow position when there is failure of the MWD tool may reduce blockage and mud pressure build up caused by the rotor being held in the restricted flow position for an extended period of time. Without self-correction, the pressure build up may lead to damage of the rotor and/or stator or other parts of the MWD tool. The pressure build up may also lead to failure of the pumps or piping on surface. Furthermore, movement of the rotor towards the open flow position may reduce or prevent debris or lost circulation material (LCM) build up which could plug the drill collar and restrict mud flow. The angled sleeve bypass channel (e.g. angled grooves 373, 473) may also reduce the torque required to rotate the rotor during normal operation and this may reduce the power needed to rotate the rotor to generate pressure pulses.

When the MWD tool 20 is used with the flow bypass sleeve of the third and fourth embodiment, the MWD tool 20 may include a mechanical stop mechanism, such as (but not limited to) the mechanical stop mechanism disclosed in U.S. Patent Application 62/440,012 or International Publication WO 2014/071519 (incorporated herein by reference). The mechanical stop mechanism may be included in the tool to prevent further rotation of the rotor beyond the open flow position when there is failure of the MWD tool 20.

In alternative embodiments, the angled sleeve bypass channel may be any channel extending through the flow bypass sleeve with a fluid inlet and a fluid outlet and need not be the angled grooves 373, 473 of the third and fourth embodiment of the flow bypass sleeve. The angled sleeve bypass channel is positioned such that the rotor projections rotate in and out of fluid communication with the angled sleeve bypass channel when the fluid pressure pulse generator is received in the bore of the sleeve body. In alternative embodiments, only a portion of the angled sleeve bypass channel may be angled and the remainder of the sleeve bypass channel may extend along the longitudinal axis of the flow bypass sleeve. In alternative embodiments, the angled sleeve bypass channel may be an aperture extending through the flow bypass sleeve with a fluid outlet on the internal surface of the flow bypass sleeve, with the outlet positioned uphole or adjacent the rotor projections so that mud discharging from the outlet of the angled sleeve bypass channel impinges on the rotor projections to rotate the rotor towards the open flow position. Mud flowing along the angled sleeve bypass channel and discharging from the fluid outlet may have a vector with at least a lateral component and a longitudinal component. The mud being discharged may also have a radial component.

When the flow bypass sleeve of the third and fourth embodiment is used in combination with the first or second embodiment of the fluid pressure pulse generator 130, 230, the angled rotor bypass channels (apertures 124 and/or grooves 220) of the fluid pressure pulse generator 130, 230 and the angled grooves 373, 473 of the flow bypass sleeve work in combination to rotate the rotor 160, 260 towards the open flow position if there is failure of the MWD tool 20 and this may result in quicker self-correction of the rotor 160, 260 to the open flow position when there is failure of the MWD tool 20 which may beneficially reduce the likelihood of damage caused by pressure build up. The angled rotor bypass channels (apertures 124 and/or grooves 220) of the fluid pressure pulse generator 130, 230 and the angled grooves 373, 473 of the flow bypass sleeve may also have the combined effect of reducing the torque required to rotate the rotor during normal operation.

The external dimensions of the flow bypass sleeve may be adapted to fit any sized drill collar. It is therefore possible to use a one size fits all fluid pressure pulse generator with multiple sized flow bypass sleeves with various different external circumferences that are dimensioned to fit different sized drill collars. Each of the multiple sized flow bypass sleeves may have the same internal dimensions to receive the one size fits all fluid pressure pulse generator but different external dimensions to fit the different sized drill collars.

In larger diameter drill collars, the volume of mud flowing through the drill collar will generally be greater than the volume of mud flowing through smaller diameter drill collars, however the bypass channels (e.g. grooves 173, 373, 473 and/or apertures 275, 475) of the flow bypass sleeve may be dimensioned to accommodate this greater volume of mud. The bypass channels of the different sized flow bypass sleeves may therefore be dimensioned such that the volume of mud flowing through the one size fits all fluid pressure pulse generator fitted within any sized drill collar is within an optimal range for generation of pressure pulses which can be detected at the surface without excessive pressure build up. It may therefore be possible to control the flow area of mud through the fluid pressure pulse generator using different flow bypass sleeves rather than having to fit different sized fluid pressure pulse generators to the pulser assembly.

In alternative embodiments (not shown), the fluid pressure pulse generator 130, 230 may be present in the drill collar 27 without the flow bypass sleeve. In these alternative embodiments, the stator projections 142, 242 and rotor projections 162, 262 may be radially extended to have an external diameter that is greater than the external diameter of the cylindrical section of the stator body 141, 241 such that mud following along annular channel 55 impinges on the stator projections 142, 242 and is directed through the stator flow channels 143, 243. The stator projections 142, 242 and rotor projections 162, 262 may radially extend to meet the internal surface of the drill collar 27. There may be a small gap between the rotor projections 162, 262 and the internal surface of the drill collar 27 to allow rotation of the rotor projections 162, 262. The innovative aspects apply equally in embodiments such as these.

While particular embodiments have been described in the foregoing, it is to be understood that other embodiments are possible and are intended to be included herein. It will be clear to any person skilled in the art that modification of and adjustments to the foregoing embodiments, not shown, are possible.

The invention claimed is:

1. A flow bypass sleeve for a fluid pressure pulse generator of a downhole telemetry tool comprising a plurality of radially extending stator projections spaced around a stator body and a plurality of radially extending rotor projections spaced around a rotor body and axially adjacent the stator projections, the flow bypass sleeve being configured to fit inside a drill collar which houses the telemetry tool and comprising a sleeve body with a bore therethrough which receives the fluid pressure pulse generator, the sleeve body comprising at least one longitudinally extending angled sleeve bypass channel with a fluid inlet and a fluid outlet, wherein the fluid outlet is on an internal surface of the sleeve body and is downhole and lateral relative to the fluid inlet, and wherein the at least one angled sleeve bypass channel is positioned such that the rotor projections rotate in and out of fluid communication with the at least one angled sleeve bypass channel when the fluid pressure pulse generator is received in the bore of the sleeve body and the rotor projections are rotating relative to the stator projections to generate fluid pressure pulses in fluid flowing through the fluid pressure pulse generator.

2. The flow bypass sleeve of claim 1, wherein the at least one angled sleeve bypass channel comprises an angled groove longitudinally extending along an internal surface of the sleeve body.

3. The flow bypass sleeve of claim 2, wherein the sleeve body further comprises at least one bypass aperture longitudinally extending through the sleeve body, wherein the fluid flows through the at least one bypass aperture and the angled groove.

4. The flow bypass sleeve of claim 2, wherein the sleeve body comprises a plurality of angled grooves longitudinally extending along an internal surface of the sleeve body and the plurality of angled grooves are positioned such that the rotor projections rotate in and out of fluid communication with the plurality of angled grooves when the fluid pressure pulse generator is received in the bore of the sleeve body and the rotor projections are rotating relative to the stator projections to generate fluid pressure pulses in fluid flowing through the fluid pressure pulse generator.

5. A telemetry tool comprising:

(i) a pulser assembly comprising a housing enclosing a motor coupled with a driveshaft;

(ii) a fluid pressure pulse generator comprising:

(a) a stator comprising a stator body and a plurality of radially extending stator projections spaced around the stator body, whereby adjacently spaced stator projections define stator flow channels extending therebetween; and (b) a rotor comprising a rotor body and a plurality of radially extending rotor projections spaced around the rotor body, and (iii) a flow bypass sleeve configured to fit inside a drill collar which houses the telemetry tool and comprising a sleeve body with a bore therethrough which receives the fluid pressure pulse generator, the sleeve body comprising at least one longitudinally extending angled sleeve bypass channel with a fluid inlet and a fluid outlet, wherein the fluid outlet is on an internal surface of the sleeve body and is downhole and lateral relative to the fluid inlet, wherein the driveshaft is coupled to the rotor and the motor rotates the driveshaft and rotor relative to the stator such that the rotor projections move in and out of fluid communication with the stator flow channels to generate fluid pressure pulses in fluid flowing through the stator flow channels, and wherein the at least one angled sleeve bypass channel is positioned such that the rotor projections rotate in and out of fluid communication with the at least one angled sleeve bypass channel when the rotor is rotating relative to the stator to generate the fluid pressure pulses.

6. The telemetry tool of claim 5, wherein the at least one angled sleeve bypass channel comprises an angled groove longitudinally extending along an internal surface of the sleeve body.

7. The telemetry tool of claim 6, wherein the sleeve body further comprises at least one bypass aperture longitudinally extending through the sleeve body, wherein the fluid flows through the at least one bypass aperture and the angled groove.

8. The telemetry tool of claim 6, wherein the sleeve body comprises a plurality of angled grooves longitudinally extending along an internal surface of the sleeve body and the plurality of angled grooves are positioned such that the rotor projections rotate in and out of fluid communication with the plurality of angled grooves when the rotor projections are rotating relative to the stator projections to generate the fluid pressure pulses.

9. The telemetry tool of claim 5, wherein the rotor projections are axially adjacent the stator projections, and wherein at least one of the rotor projections has an angled rotor bypass channel which moves in and out of fluid communication with the stator flow channels as the rotor rotates relative to the stator, the angled rotor bypass channel extending through or along a surface of the at least one rotor projection and having a fluid inlet and a fluid outlet downhole and lateral relative to the fluid inlet.

10. The telemetry tool of claim 5, wherein the stator body has a bore therethrough and is fixedly coupled with the housing, and wherein the rotor is fixedly coupled with the driveshaft, with the driveshaft and/or the rotor body received within the bore of the stator body such that the stator projections are positioned between the pulser assembly and the rotor projections.

11. The telemetry tool of claim 10, wherein the rotor body has a bore therethrough and the telemetry tool further comprises a rotor cap comprising a cap body and a cap shaft, the cap shaft being received in the bore of the rotor body and configured to releasably couple the rotor body to the driveshaft.

* * * * *